US011123990B2

(12) United States Patent
Matsumoto et al.

(10) Patent No.: US 11,123,990 B2
(45) Date of Patent: Sep. 21, 2021

(54) LIQUID OUTPUT APPARATUS, MAINTENANCE CONTROL METHOD, AND RECORDING MEDIUM

(71) Applicants: Tetsuya Matsumoto, Ibaraki (JP); Tomohiro Mizutani, Tokyo (JP); Kohsuke Inoue, Kanagawa (JP); Shinichiroh Hirabayashi, Kanagawa (JP)

(72) Inventors: Tetsuya Matsumoto, Ibaraki (JP); Tomohiro Mizutani, Tokyo (JP); Kohsuke Inoue, Kanagawa (JP); Shinichiroh Hirabayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/432,512

(22) Filed: Jun. 5, 2019

(65) Prior Publication Data

US 2019/0375210 A1 Dec. 12, 2019

(30) Foreign Application Priority Data

Jun. 7, 2018 (JP) ..... JP2018-109793

(51) Int. Cl.
*B41J 2/165* (2006.01)

(52) U.S. Cl.
CPC ..... *B41J 2/16517* (2013.01)

(58) Field of Classification Search
CPC ..... B41J 2/16517
See application file for complete search history.

(56) References Cited

U.S. PATENT DOCUMENTS

| | | | | |
|---|---|---|---|---|
| 2012/0062640 | A1* | 3/2012 | Uraki | B41J 11/002 347/18 |
| 2012/0230719 | A1 | 9/2012 | Matsumoto | |
| 2015/0224775 | A1 | 8/2015 | Matsumoto | |
| 2015/0246542 | A1* | 9/2015 | Schneider | B41J 2/16552 347/22 |
| 2016/0152030 | A1* | 6/2016 | Nawano | B41J 2/1652 347/30 |
| 2017/0001445 | A1 | 1/2017 | Matsumoto | |
| 2017/0129244 | A1* | 5/2017 | Kurogochi | B41J 2/16585 |
| 2017/0266964 | A1* | 9/2017 | Hattori | B41J 2/04586 |

FOREIGN PATENT DOCUMENTS

| | | |
|---|---|---|
| JP | 2003-127403 | 5/2003 |
| JP | 2006-102992 | 4/2006 |
| JP | 2012-166374 | 9/2012 |
| JP | 2014-100805 | 6/2014 |
| JP | 2015-150691 | 8/2015 |
| JP | 2017-013045 | 1/2017 |

* cited by examiner

*Primary Examiner* — Jason S Uhlenhake
(74) *Attorney, Agent, or Firm* — Harness, Dickey & Pierce, P.L.C.

(57) ABSTRACT

A liquid output apparatus includes a plurality of liquid output heads and a maintenance assembly. The plurality of liquid output heads is arranged in a staggered arrangement. The maintenance assembly is configured to perform maintenance on the plurality of liquid output heads in different rows in a set.

17 Claims, 15 Drawing Sheets

LIQUID OUTPUT APPARATUS, MAINTENANCE CONTROL METHOD, AND RECORDING MEDIUM

CROSS-REFERENCE TO RELATED APPLICATION

This patent application is based on and claims priority pursuant to 35 U.S.C. § 119(a) to Japanese Patent Application No. 2018-109793, filed on Jun. 7, 2018, in the Japan Patent Office, the entire disclosure of which is hereby incorporated by reference herein.

BACKGROUND

Technical Field

Aspects of the present disclosure relate to a liquid output apparatus, a maintenance control method, and a recording medium.

Related Art

A liquid output apparatus, such as an inkjet apparatus, includes a liquid output head having a nozzle to apply liquid to a recording target, such as a sheet of paper. The liquid output apparatus outputs the liquid from the nozzle to print an image on the recording target. Such a liquid output apparatus includes, for example, a head array in which a plurality of liquid output heads is arranged to output the liquid over the entire area of the recording target. In the liquid output apparatus, the liquid output heads may be clogged due to thickening or sticking of the liquid in the nozzles when the period in which the liquid is not output is long. Therefore, the liquid output apparatus is provided with a maintenance device that performs maintenance of the liquid output heads.

SUMMARY

In an aspect of the present disclosure, there is provided A liquid output apparatus includes a plurality of liquid output heads and a maintenance assembly. The plurality of liquid output heads is arranged in a staggered arrangement. The maintenance assembly is configured to perform maintenance on the plurality of liquid output heads in different rows in a set.

In another aspect of the present disclosure, there is provided a maintenance control method to be executed by a liquid output apparatus. The liquid output apparatus includes a plurality of liquid output heads arranged in a staggered arrangement and a maintenance assembly including a plurality of maintenance mechanisms corresponding to different rows, respectively, in which the plurality of liquid output heads is arranged. The method includes causing the maintenance assembly to perform maintenance on the plurality of liquid output heads, which are disposed in the different rows, in a set with the plurality of maintenance mechanisms corresponding to the different rows.

In yet another aspect of the present disclosure, there is provided a non-transitory recording medium storing program code that causes a liquid output apparatus to execute a maintenance control method. The liquid output apparatus includes a plurality of liquid output heads arranged in a staggered arrangement and a maintenance assembly including a plurality of maintenance mechanisms corresponding to different rows, respectively, in which the plurality of liquid output heads is arranged. The method includes causing the maintenance assembly to perform maintenance on the plurality of liquid output heads, which are disposed in the different rows, in a set with the plurality of maintenance mechanisms corresponding to the different rows.

BRIEF DESCRIPTION I/F THE DRAWINGS

A more complete appreciation of the disclosure and many of the attendant advantages and features thereof can be readily obtained and understood from the following detailed description with reference to the accompanying drawings, wherein.

Figure 14:
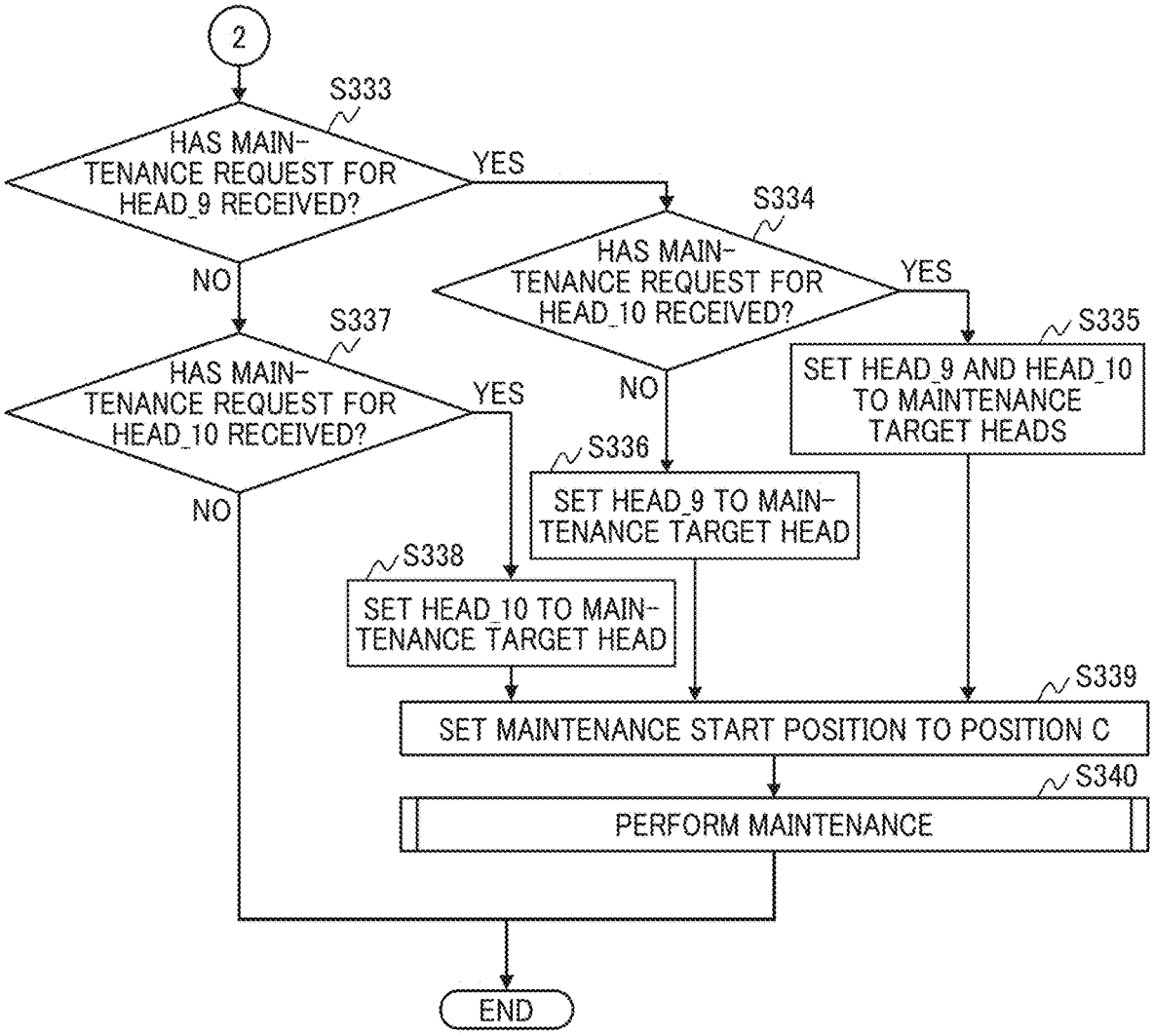
Figure 15:
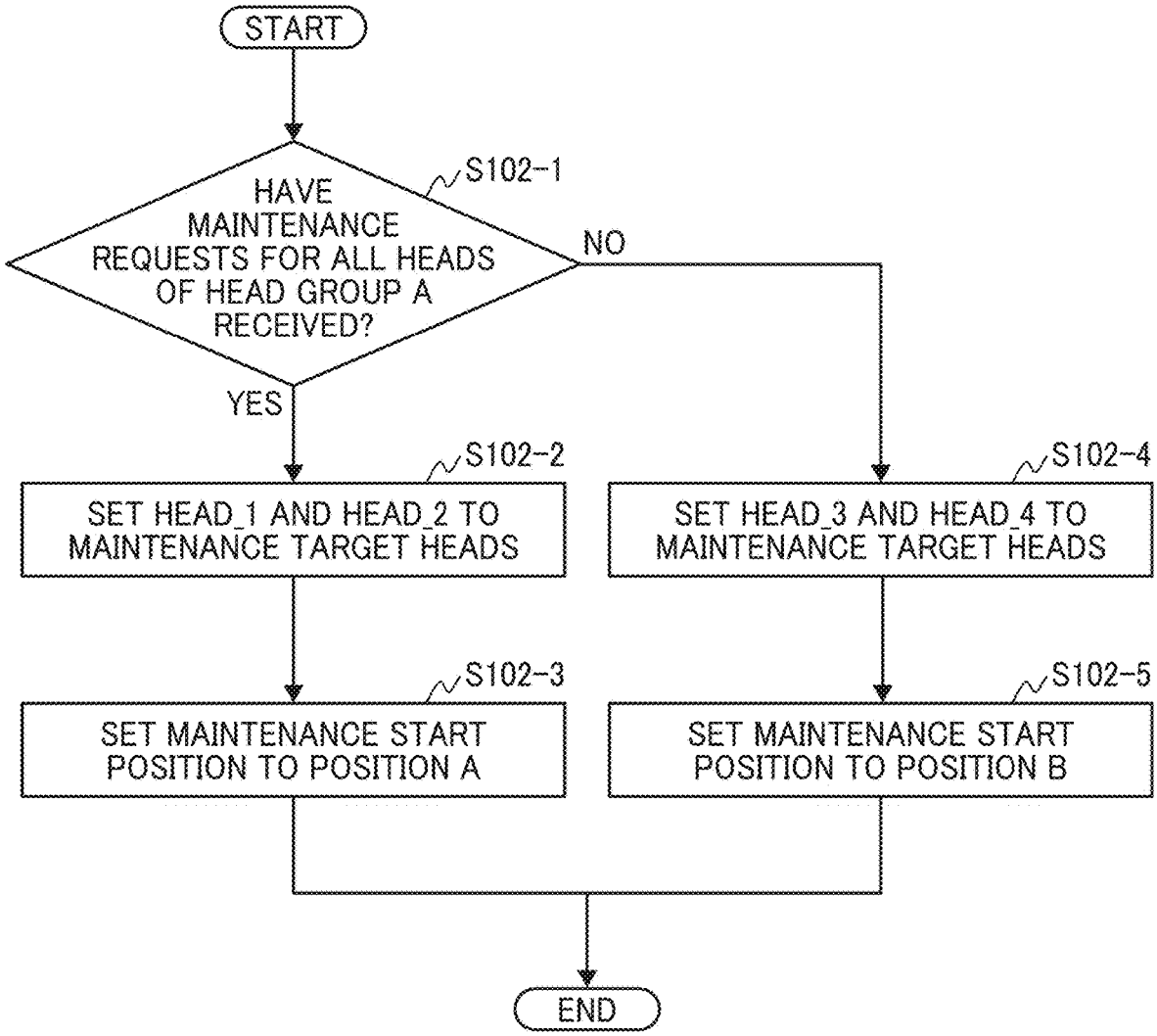

FIG. 14 is a flowchart of still another part of the example of the process of setting the liquid output head to be subjected to maintenance in the liquid output apparatus according to the first variation; and FIG. 15 is a flowchart of an example of the process of setting a liquid output head to be subjected to maintenance in the liquid output apparatus according to a second variation of an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Below, embodiments of the present disclosure are described with reference to the drawings. In the description of the drawings, the same elements are denoted by the same reference codes and redundant descriptions thereof are omitted below.

Embodiments

Liquid Output Apparatus

Figure 1:
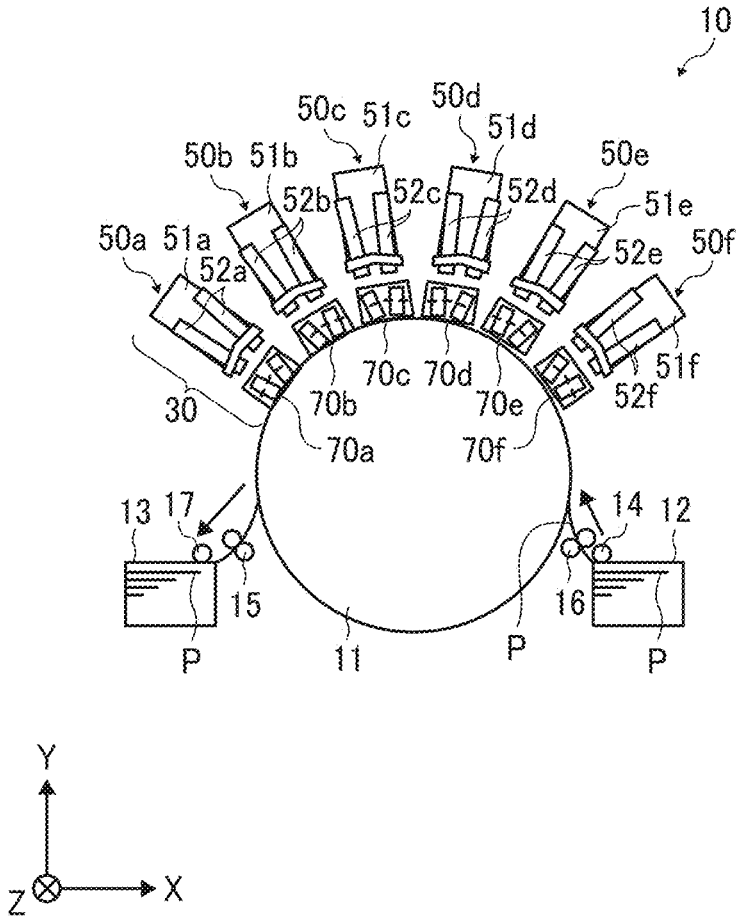
FIG. 1 is a schematic front view of an example of a configuration of a liquid output apparatus according to an embodiment of the present disclosure.

First, the outline of the configuration of a liquid output apparatus according to an embodiment of the present disclosure is described with reference to FIGS. 1 to 7. FIG. 1 is a schematic front view of an example of the configuration of the liquid output apparatus according to the present embodiment. The liquid output apparatus 10 illustrated in FIG. 1 is an apparatus that outputs liquid from liquid output heads 52*a*, 52*b*, 52*c*, 52*d*, 52*e*, and 52*f* (hereinafter referred to as the liquid output heads 52 unless necessary to be distinguished) and applies the output liquid to a recording target P. The liquid output apparatus 10 is, for example, an image forming apparatus that outputs ink as the liquid from the liquid output heads 52 to form an image on the recording target P such as a sheet of paper.

As illustrated in FIG. 1, the liquid output apparatus 10 includes a conveyance drum 11, a sheet feed tray 12, a sheet ejection tray 13, and a liquid output assembly 30. The conveyance drum 11 holds the recording target P on a circumferential surface of the conveyance drum 11 and conveys the recording target P at the time of liquid output. The sheet feed tray 12 stacks the recording target P thereon and supplies the recording target P to the conveyance drum 11. Liquid is discharged to the recording target P on the circumferential surface of the conveyance drum 11. The recording target P is conveyed by the conveyance drum 11 and is received by and stacked on the sheet ejection tray 13. The liquid output assembly 30 outputs the liquid onto the recording target P held on the circumferential surface of the conveyance drum 11.

The conveyance drum 11 conveys, for example, the recording target P sent from the sheet feed tray 12 toward the drum side. The circumferential surface of the transfer drum 11 has a plurality of small holes penetrating to a negative pressure space on the inner circumferential side of the conveyance drum 11. When a negative pressure generation pump creates a negative pressure state in the negative pressure space, the recording target P is held in close contact with the circumferential surface of the conveyance drum 11. The recording target P is, for example, a sheet of paper.

Recording targets P stacked on the sheet feed tray 12 are separated by a separation roller 14 and a sheet feed roller 16 and conveyed one by one to a conveyance portion of the conveyance drum 11 (an upper half area of the circumferential surface of the conveyance drum 11 between a sheet feed position and a sheet ejection position). Further, the recording target P to which the liquid is applied, which is to be conveyed to the sheet ejection position on the circumferential surface of the conveyance drum 11, is distributed by a sheet ejection roller 15 and a feed roller 17 and stacked on the sheet ejection tray 13.

Further, as illustrated in FIG. 1, the liquid output assembly 30 includes six head arrays 50*a*, 50*b*, 50*c*, 50*d*, 50*e*, and 50*f* (hereinafter referred to as the head array(s) 50 unless necessary to be distinguished) that are radially arranged outward on the upper side of the circumferential surface corresponding to the conveyance portion of the conveyance drum 11. The liquid output assembly further includes maintenance devices 70*a*, 70*b*, 70*c*, 70*d*, 70*e*, and 70*f* (hereinafter referred to as the maintenance device(s) 70 unless necessary to be distinguished) disposed between the circumferential surface of the conveyance drum 11 and each of the head arrays 50 at positions corresponding to the head arrays 50.

As illustrated in FIG. 1, the head array 50 includes a head array body 51*a*, 51*b*, 51*c*, 51*d*, 51*e*, or 51*f* (hereinafter referred to as the head array body 51 unless necessary to be distinguished) and a plurality of liquid output heads 52 held by the head array body 51. The longitudinal direction (Z-axis direction) of each head array body 51 coincides with the axial direction of the conveyance drum 11. Longitudinal ends of each head array body 51 correspond to longitudinal ends of the conveyance drum 11. The head array body 51 further includes an output assembly to perform output operation of the liquid from the liquid output head 52. The output mechanism includes, for example, at least one of a head tank that stores the liquid output from the liquid output head 52, a carriage, a supply mechanism, a maintenance recovery mechanism, and a main scanning movement mechanism.

Figure 2:
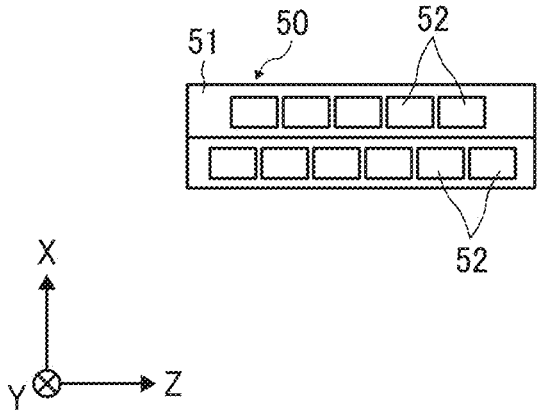
FIG. 2 is a schematic plan view of an example of a configuration of a head array according to an embodiment of the present disclosure.

The liquid output head 52 outputs liquid and applies the liquid to the recording target P. FIG. 2 is a schematic plan view of an example of the configuration of the head array according to an embodiment of the present disclosure. The head array 50 illustrated in FIG. 2 includes the plurality of liquid output heads 52 disposed in a staggered array (or staggered arrangement). The liquid output heads 52 are arranged along a sub-scanning direction (Z-axis direction) orthogonal to a main scanning direction (X-axis direction) that is a direction of rotation of the conveyance drum 11. The liquid output heads 52 in one row are offset by a half pitch from the liquid output heads 52 in the other row. The plurality of liquid output heads 52 is arranged along the first direction (Z-axis direction). Adjacent heads of the plurality of liquid output heads 52 in the first direction has an overlap region that overlaps each other when viewed in a second direction (X-axis direction) orthogonal to the first direction.

In the example of FIG. 2, the plurality of liquid output heads 52 includes five heads in one row and six heads in the other row. The number of liquid output heads 52 is not limited to the example of FIG. 2, and the number of liquid output heads 52 in each row may be five or six or more. The same number of liquid output heads 52 may be provided in each row.

Returning to FIG. 1, the maintenance device 70 is a device that performs maintenance on a liquid application surface (nozzle formation surface) and the periphery of the liquid application surface of the liquid output head 52. The maintenance is, for example, a process for performing maintenance, servicing, or inspection for preventing or eliminating clogging caused by thickening or sticking of the liquid in the liquid output head 52.

As illustrated in FIG. 1, the maintenance device 70 (70*a*, 70*b*, 70*c*, 70*d*, 70*e*, or 700 is disposed between the circumferential surface of the conveyance drum 11 and each head array 50. The maintenance devices 70 are provided corresponding to the head arrays 50, respectively, and the same number of maintenance devices 70 as the number of head arrays 50 are provided. Each of the maintenance devices 70 performs maintenance on the liquid output head 52 provided in the corresponding head array 50.

Figure 3:
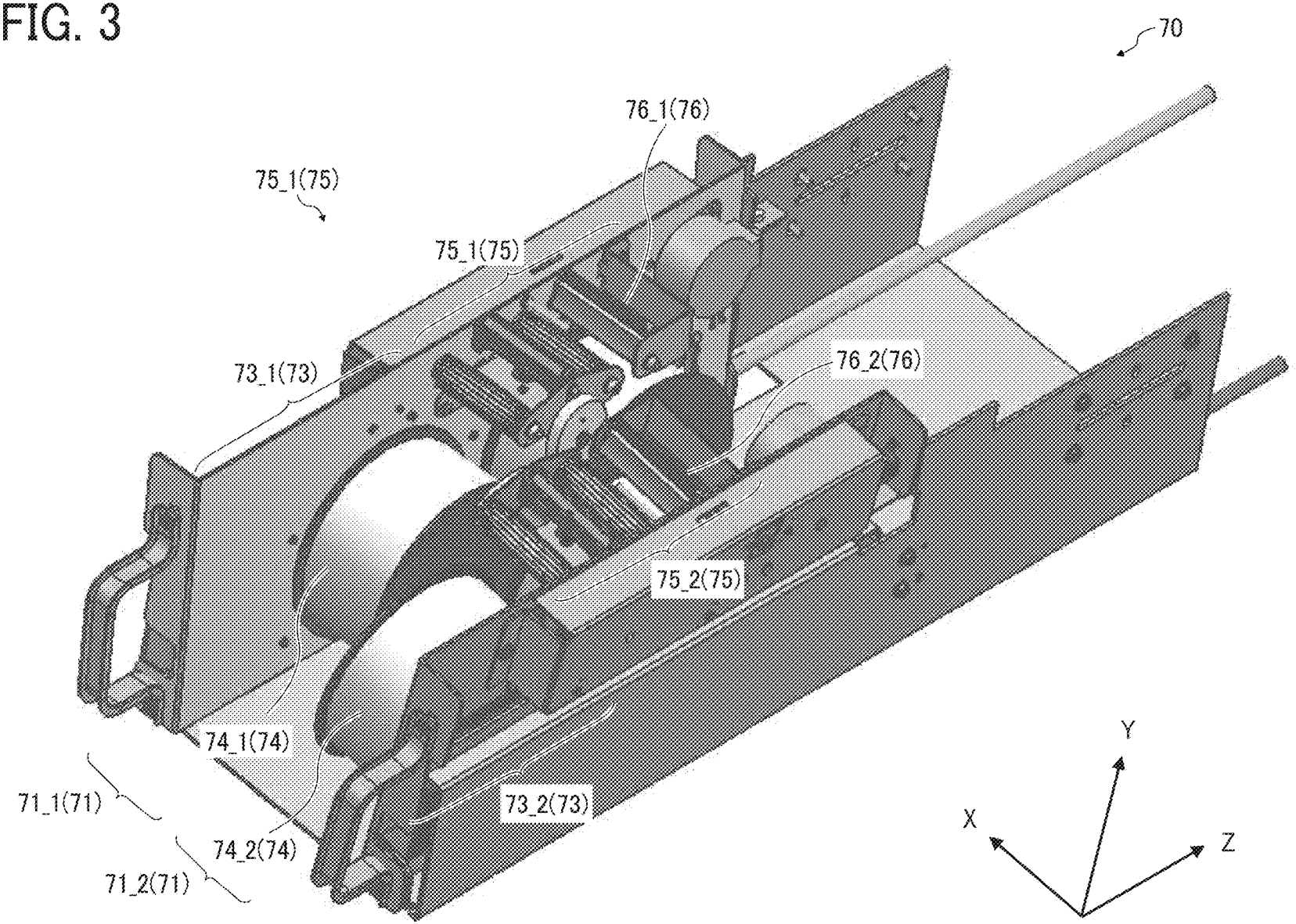
FIG. 3 is a schematic perspective view of an example of a configuration of a maintenance device according to an embodiment of the present disclosure.

Here, an example of the configuration of the maintenance device 70 is described. FIG. 3 is a schematic perspective view of an example of the configuration of the maintenance device according to an embodiment of the present disclosure. The maintenance device 70 illustrated in FIG. 3 includes a maintenance mechanism 71_1 and a maintenance mechanism 71_2 (hereinafter referred to as the maintenance mechanism(s) 71 unless necessary to be distinguished). The maintenance mechanisms 71 are provided in the same number as the number of rows in which the liquid output heads 52 are provided. When the maintenance device 70 is provided corresponding to the head array 50 that includes the liquid output heads 52 provided in, for example, a two-row staggered arrangement as illustrated in FIG. 2, the maintenance device 70 includes two maintenance mechanisms 71 (71_1 and 71_2). The two maintenance mechanisms 71_1 and 71_2 are shifted from each other by the same distance as a distance between one pair of liquid output heads 52 (for example, two liquid output heads 52 provided adjacent to each other (at the shortest distance) among the liquid output heads 52 provided in different rows).

The maintenance mechanisms 71_1 and 71_2 include web units 73_1 and 73_2 (hereinafter referred to as web unit(s) 73 unless necessary to be distinguished) and wiper units 75_1 and 75_2 (hereinafter referred to as wiper unit(s) 75 unless necessary to be distinguished), respectively.

The web unit 73 is a mechanism with a web 74 (74_1 or 74_2) to wipe a liquid output surface (nozzle formation surface) of the liquid output head 52. The web 74 is made of a material having liquid absorbability, preferably a non-woven fabric. The web unit 73 includes a web pressing mechanism that pushes up the web 74 to a level (in the Y-axis direction) at which the web 74 wipes the liquid output surface of the liquid output head 52. The web pressing mechanism operates to push up the web 74 in the Y-axis direction at the time of maintenance and pull the web 74 down in the Y-axis direction at the end of the maintenance. The web 74 is pressed against the liquid output surface of the liquid output head 52, and the maintenance device 70 moves in the sub-scanning direction (Z-axis direction) to absorb and wipe the liquid or the like attached to the liquid output surface.

The web unit 73 also includes a cleaning liquid supply mechanism to discharge and apply cleaning liquid onto the web 74. The cleaning liquid contains water, a pigment-free ink component, or a component that dissolves hardened ink. A portion of the web 74, to which the cleaning liquid is discharged and applied, is pressed against the liquid output surface of the liquid output head 52 to clean the liquid output head 52.

The wiper unit 75 is a mechanism with a wiper 76 that wipes the liquid attached to the liquid output surface (nozzle formation surface) of the liquid output head 52 or the dust or the like generated from the recording target P. The wiping of the wiper unit 75 is performed to remove the liquid, dust, and the like on the liquid output surface which cannot be removed by the web unit 73. The wiper 76 is made of a material having liquid repellency to the liquid output from the liquid output head 52. The wiper 76 is made of, for example, a material such as rubber or a synthetic resin.

The wiper unit 75 includes a wiper moving mechanism that moves the wiper 76 to a level (in the Y-axis direction) at which the wiper 76 wipes the liquid output surface of the liquid output head 52. The wiper 76 is moved by the wiper moving mechanism at the time of maintenance and is in contact with the liquid output surface of the liquid output head 52. In such a state, the wiper 76 wipes the liquid or the like attached to the liquid output surface as the maintenance device 70 moves in the sub-scanning direction (Z-axis direction).

In addition to the web unit 73 and the wiper unit 75, the maintenance device 70 may include a suction cap to suck the liquid output surface of the liquid output head 52 and a moisturizing cap to maintain the liquid output surface of the liquid output head 52 in a moisturized state.

Figure 4:
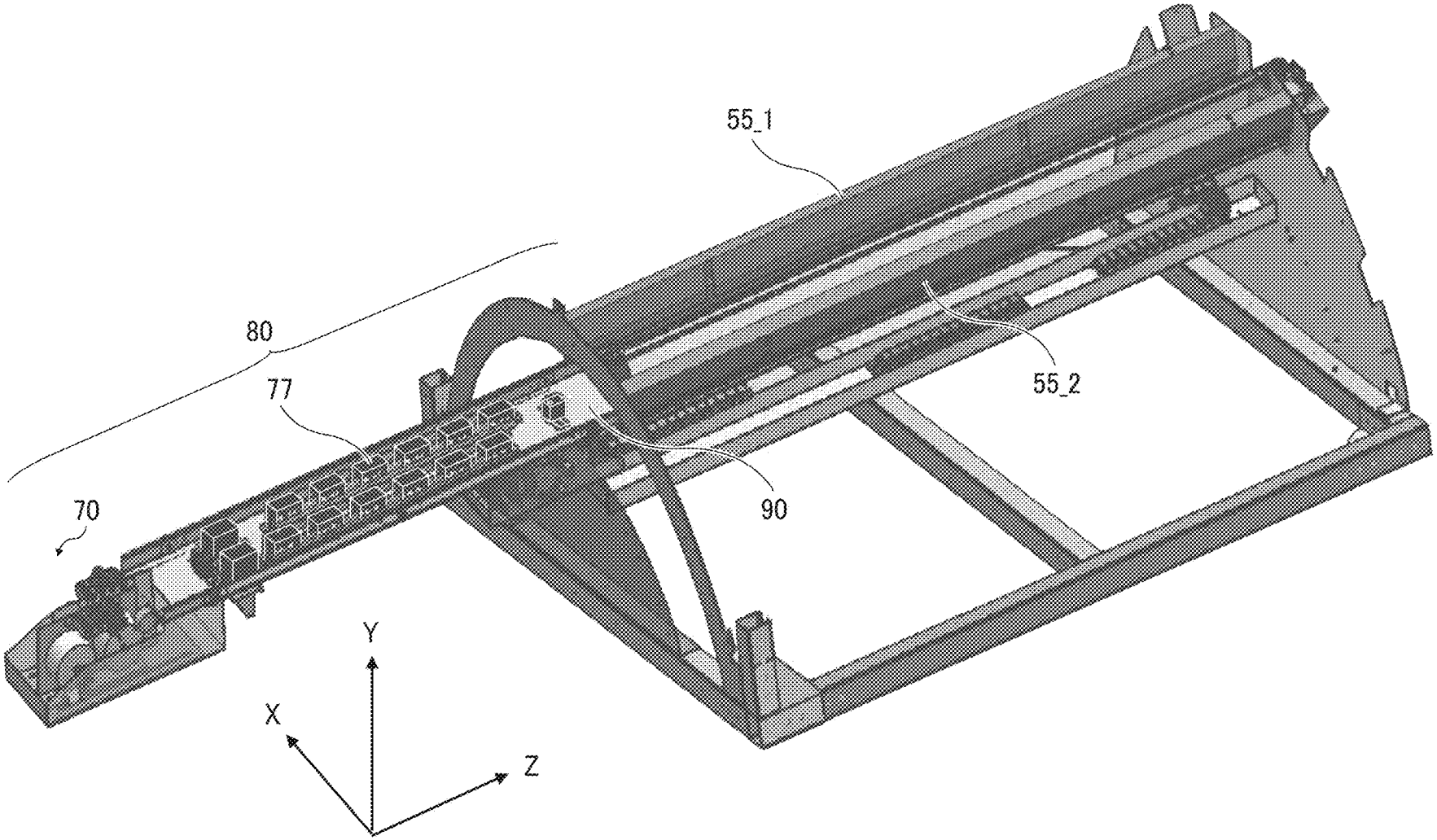
FIG. 4 is a schematic perspective view of an example of an arrangement of the head array, a moving mechanism, and the maintenance device in a liquid output assembly according to an embodiment of the present disclosure.

FIG. 4 is a schematic perspective view of an example of the arrangement of the head array, a moving mechanism, and the maintenance device in the liquid output assembly according to an embodiment of the present disclosure. The maintenance device 70 illustrated in FIG. 3 is secured to a moving mechanism 90 movable in a row direction (Z-axis direction) with respect to head rows 55_1 and 55_2 in which the liquid output heads 52 are arranged. The moving mechanism 90 illustrated in FIG. 4 includes, for example, moisturizing caps 77 that prevent the liquid output surfaces of the liquid output heads 52 from being dried. The state illustrated in FIG. 4 is a state in which the maintenance is not being performed, and the maintenance device 70 is located at a retreat position (retreat area) RP. Receiving a maintenance start request described later, the maintenance device 70 is moved in the column direction (Z-axis direction) by the moving mechanism 90 to perform maintenance on the liquid output head 52. The maintenance device 70 and the moving mechanism 90 illustrated in FIG. 5 constitute a maintenance assembly 80. The maintenance assembly 80 may have a configuration in which the maintenance device 70 and the moving mechanism 90 are integrated.

Figure 5:
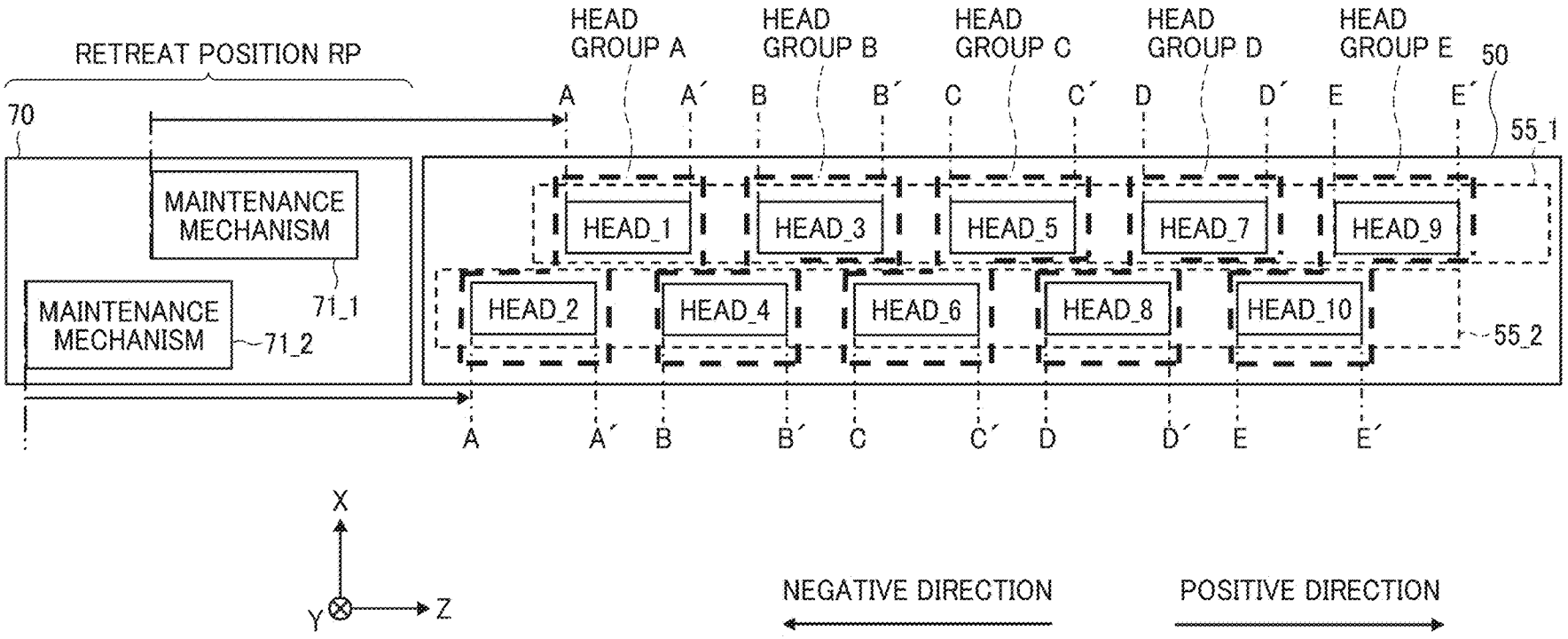
FIG. 5 is a schematic view of an example of an operation of the maintenance device to be performed on the head array in the liquid output apparatus according to an embodiment of the present disclosure.

FIG. 5 is a schematic view of an example of an operation of the maintenance device to be performed on the head array in the liquid output apparatus according to an embodiment of the present disclosure. With reference to FIG. 5, a description is given of the case in which the head array 50 includes a plurality of liquid output heads 52 arranged in a two-row staggered arrangement (head rows 55_1 and 55_2) as illustrated in FIG. 2. The number of rows in which the liquid output heads 52 are arranged is not limited to such an example, and the liquid output heads 52 may be arranged in a staggered arrangement of three or more rows.

As illustrated in FIG. 5, the maintenance device 70 is located at the retreat position (retreat area) RP in a normal state (a state in which the maintenance is not being performed). The maintenance device 70 is moved in the Z-axis direction (forward direction) by the moving mechanism 90 illustrated in FIG. 4 when the maintenance for the liquid output head 52 is needed. The maintenance device 70 performs maintenance while reciprocating in the horizontal direction sequentially from the liquid output head 52 closer to the retreat position (retreat area) RP.

The head array 50 includes head groups (head groups A, B, C, D, and E), each group including liquid output heads 52 nearest between the adjacent head rows (55_1, 55_2). The head group A includes, for example, a head_1 arranged in the head row 55_1 and a head_2 adjacent to the head_1 among the heads arranged in the head row 55_2. The head group B includes, for example, a head_3 arranged in the head row 55_1 and a head_4 adjacent to the head_3 among the heads arranged in the head row 55_2. The head group C includes, for example, a head_5 arranged in the head row 55_1 and a head_6 adjacent to the head_5 among the heads arranged in the head row 55_2. The head group D includes, for example, a head_7 arranged in the head row 55_1 and a head_8 adjacent to the head_7 among the heads arranged in the head row 55_2. The head group E includes, for example, a head_9 arranged in the head row 55_1 and a head_10 adjacent to the head_9 among the heads arranged in the head row 55_2.

The plurality of liquid output heads 52 belonging to each head group are arranged to have a predetermined relative positional relationship. That is, the relative positional relationship between the liquid output heads 52 belonging to each head group is the same in all the head groups. For example, the positional relationship between the head_1 and the head_2 belonging to the head group A is the same as the positional relationship between the head_3 and the head_4 belonging to the head group B. The number of liquid output heads 52 belonging to the head group is not limited to the above-described example. When the number of head rows is three or more, the number of liquid output heads 52 corresponding to the number of rows may be included. For example, when the number of head rows is three, the head group may include three liquid output heads 52 provided one by one in each row. Here, the liquid output head 52 (for example, the head_1) provided in the head row 55_1 is an example of a first liquid output head, and the liquid output head 52 (for example, the head_2) provided in the head row 55_2. Is an example of a second liquid output head.

The maintenance device 70 includes the maintenance mechanisms 71 (71_1 and 71_2) at positions corresponding to the relative positional relationship of the plurality of liquid output heads 52 belonging to the head group. The maintenance mechanisms 71 are arranged to have a specific relative positional relationship corresponding to the relative positional relationship between the plurality of liquid output heads 52 belonging to the head group. The maintenance mechanism 71_1 is provided, for example, to maintain the liquid output heads 52 in the head row 55_1. The maintenance mechanism 71_2 is provided, for example, to maintain the liquid output heads 52 in the head row 55_2. That is, the relative positional relationship between the maintenance mechanism 71_1 and the maintenance mechanism 71_2 corresponds to the relative positional relationship between the head_1 and the head_2 belonging to the head group A. Here, the maintenance mechanism 71_1 is an example of a first maintenance mechanism, and the maintenance mechanism 71_2 is an example of a second maintenance mechanism.

Here, an example of the maintenance of the liquid output head 52 illustrated in FIG. 5 is described. First, the moving mechanism 90 illustrated in FIG. 4 moves the maintenance device 70 from the retreat position RP to the forward direction (Z-axis direction) so that the maintenance device 70 is located at a position A which is a maintenance start position of the head group A (head_1 and the head_2). As a result, the maintenance mechanisms 71_1 and 71_2 in the maintenance device 70 are disposed at positions at which the maintenance is performed on the heads 1 and 2 arranged in the staggered arrangement.

Next, the maintenance device 70 wipes the head_1 and the head_2 using the web units 73 (73_1 and 73_2) included in the maintenance mechanism 71_1 and the maintenance mechanism 71_2. For example, the maintenance device 70 is moved in the forward direction by the moving mechanism 90, and the webs 74 of the maintenance mechanism 71_1 and the maintenance mechanism 71_2 are moved to a position A'. Thus, the head_1 and the head_2 are wiped and cleaned by the web 24 in a set.

Next, the moving mechanism 90 illustrated in FIG. 4 moves the maintenance device 70 in the backward direction (Z-axis direction) so that the maintenance device 70 is located again at the position A which is the maintenance start position of the head group A (head_1 and the head_2). The maintenance device 70 wipes the head_1 and the head_2 using the wiper units 75 (75_1, 75_2) of the maintenance mechanism 71_1 and the maintenance mechanism 71_2. For example, the maintenance device 70 is moved in the forward direction by the moving mechanism 90, and the wipers 76 of the maintenance mechanism 71_1 and the maintenance mechanism 71_22 are moved to the position A'. Thus, the head_1 and the head_2 are wiped by the wipers 76 in a set.

By the above-described operation, the maintenance device 70 completes the maintenance of the head_1 and the head_2 belonging to the head group A in a set. Here, the phrase "performing maintenance in a set" means performing maintenance on a plurality of liquid output heads 52 simultaneously or by a control operation of one (common) drive source. Next, the moving mechanism 90 moves the maintenance device 70 in the forward direction (Z-axis direction) such that the maintenance device 70 is located at a position B which is a maintenance start position of the head group B (the heads 3 and 4). The maintenance device 70 repeats such a maintenance operation to perform maintenance of all the liquid output heads 52 of the head array 50.

As described above, using the maintenance device 70 that includes the maintenance mechanisms 71 at the positions having the specific relative positional relationship corresponding to the relative positional relationship of the liquid output heads 52 belonging to each head group, the liquid output apparatus 10 can perform maintenance on the plurality of liquid output heads 52 belonging to the head group in a set.

Conventionally, when performing maintenance on liquid output heads provided in different rows, a maintenance device is moved to each row in which liquid output heads are arranged, thus hampering one (common) drive source from performing control of the maintenance. Such a configuration also hampers the maintenance operation of the liquid output heads 52 arranged in different rows from being controlled by a control operation of one (common) drive source in accordance with a maintenance request received by an operator. Hence, according to the present embodiment, the liquid output apparatus 10 can perform maintenance of all the liquid output heads 52 belonging to the head group in a set by one control unit, and can perform maintenance on designated liquid output heads 52 in a set in accordance with the maintenance request received by the operator. Accordingly, the liquid output apparatus 10 can reduce the time required to perform maintenance on the plurality of liquid output heads 52 of the liquid output apparatus 10.

In the above-described configuration, one moving mechanism 90 is provided corresponding to one head array 50 or the maintenance device 70. In some embodiments, a configuration may be employed in which only one moving mechanism 90 is provided for the six maintenance devices 70 illustrated in FIG. 1.

The moving speed of the maintenance device 70 is preferably about 50 to 80 mm/s. A main body of the maintenance device 70 can be formed by plastic molding, thus allowing the maintenance device 70 to be relatively lightweight. Thus, a drive source (for example, a motor 920 described later) of the moving mechanism 90 for moving the maintenance device 70 can be small and inexpensive.

Hardware Configuration

Next, the hardware configuration of the liquid output apparatus 10 is described with reference to FIGS. 6 and 7. In an embodiment, the hardware configuration of the liquid output apparatus 10 may be the same as any of the hardware configurations illustrated in FIG. 6 and FIG. 7, or components may be added to or omitted from any of the configurations illustrated in FIGS. 6 and 7 as necessary.

Figure 6:
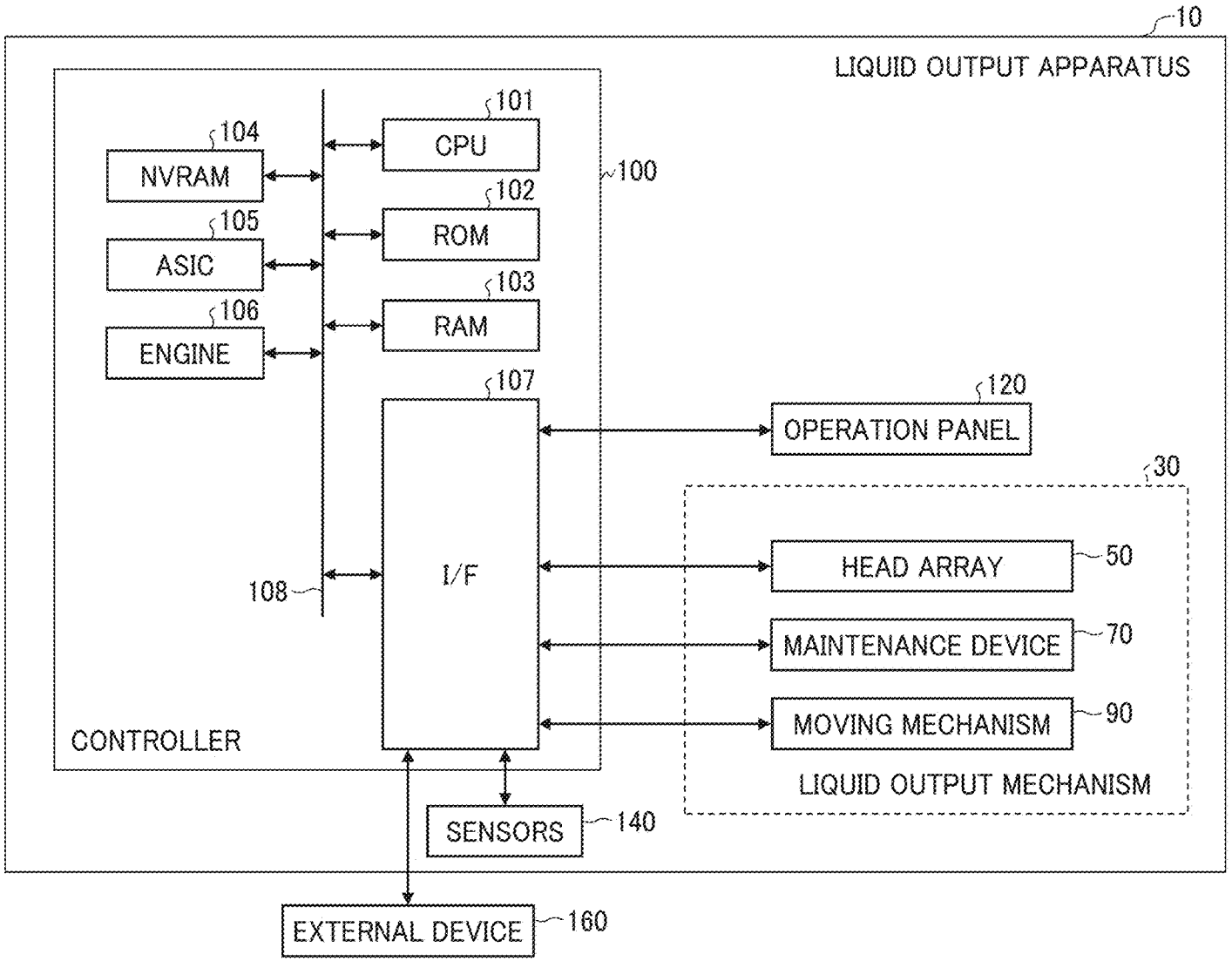
FIG. 6 is a diagram of an example of a hardware configuration of the liquid output apparatus according to an embodiment of the present disclosure.
Figure 7:
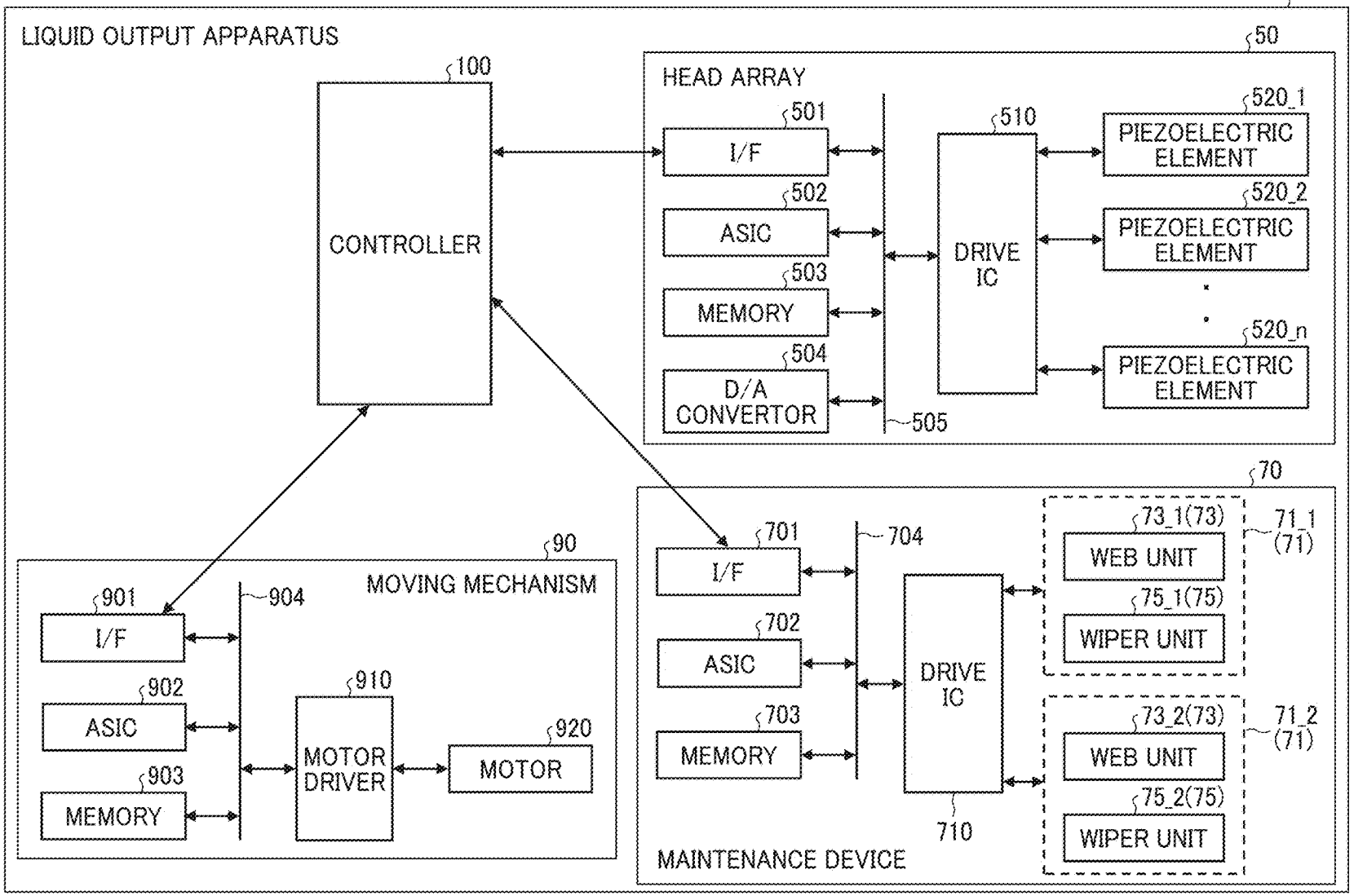
FIG. 7 is a block diagram of an example of a hardware configuration of the liquid output assembly of the liquid output apparatus according to an embodiment of the present disclosure.

FIG. 6 is a diagram of an example of the hardware configuration of the liquid output apparatus according to an embodiment of the present disclosure. The liquid output apparatus 10 includes a controller 100 that controls the operation of the liquid output apparatus 10. The controller 100 is, for example, a board or an integral circuit (IC) chip mounted inside the liquid output apparatus 10. The controller 100 includes a central processing unit (CPU) 101, a read only memory (ROM) 102, a random access memory (RAM) 103, a non-volatile RAM (NVRAM) 104, an application specific integrated circuit (ASIC) 105, an engine 106, an Interface (I/F) 107, and a bus line 108.

The CPU 101 is an integrated circuit that performs processing for controlling the entire liquid output apparatus 10. The ROM 102 is a storage device that stores a program that controls the CPU 101. The ROM 102 stores various information, control programs, and the like. In the liquid output apparatus 10, for example, the CPU 101 executes a program according to an embodiment of the present disclosure to achieve a maintenance control method according to an embodiment of the present disclosure. The RAM 103 is a storage device that functions as a work area of the CPU 101.

The NVRAM 104 is a non-volatile memory and is a storage device that retains data while a power source of the liquid output apparatus 10 is shut off. The NVRAM 104 stores device-specific information, updatable information, and the like. The NVRAM 104 may be removable from the controller 100. The ASIC 105 performs image processing that performs various signal processing and the like on processing data (information), and performs processing on other input-and-output signals for controlling the entire liquid output apparatus 10.

The engine 106 is a mechanism that executes an image forming process by liquid output in the liquid output apparatus 10.

The I/F 107 is an interface connected to an external device 160, such as a computer, provided outside the liquid output apparatus 10, to transmit and receive data (information) and signals with the external device 160. The I/F 107 may not be directly connected to the external device 160 but may be connected to a network, such as the Internet or an intranet. The I/F 107 is connected to an operation panel 120, the head array 50, the maintenance device 70, the moving mechanism 90, and various sensors 140 provided inside the liquid output apparatus 10.

The bus line 108 is commonly connected to the above-described components and transmits address signals, data signals, various control signals, and the like. The CPU 101, the ROM 102, the RAM 103, the NVRAM 104, the ASIC 105, the engine 106, and the I/F 107 are mutually connected via the bus line 108.

The liquid output apparatus 10 further includes the operation panel 120, the head array 50, the maintenance device 70, the moving mechanism 90, and the various sensors 140. The operation panel 120 is connected to the I/F 107 of the controller 100 using a universal serial bus (USB) cable or the like. The operation panel 120 has various operation keys, a character display of an liquid crystal display (LCD) or a cathode-ray tube (CRT) as a display device, and a touch panel. The liquid output apparatus 10 can input data, execute a job, and display data by receiving an operation on the operation panel 120 by the operator.

The head array 50, the maintenance device 70, and the moving mechanism 90 are connected to the I/F 107 of the controller 100 and transmit and receive data (information) and signals to and from the controller 100. The head array 50, the maintenance device 70, and the moving mechanism 90 play a role as the liquid output assembly 30.

The various sensors 140 are connected to the I/F 107 of the controller 100 and transmit and receive sensing data and signals to and from the controller 100. The various sensors 140 are, for example, a home position sensor of the liquid output head 52, a sheet position sensor that detects the position of the recording target P, and a sensor that detects the internal environment, such as temperature and humidity.

Subsequently, an example of the configuration of the liquid output assembly 30 is described. FIG. 7 is a diagram of an example of the hardware configuration of the liquid output apparatus according to an embodiment of the present disclosure.

The head array 50 includes an I/F 501, an ASIC 502, a memory 503, a digital-to-analog (D/A) converter 504, a bus line 505, a drive IC 510, and piezoelectric elements 520 (502_1, 502_2, . . . , **502_*n***: n represents natural number).

The I/F 501 is connected to the controller 100 and receives data (information) and signals from the controller 100. The data transmitted from the controller 100 is, for example, drive waveform data for causing the liquid output head 52 to output liquid. The ASIC 502 performs various signal processing and the like on data (information) and signals received from the controller 100. The ASIC 502 processes control signals to control the output of the liquid from the liquid output head 52. The memory 503 stores, for example, data received from the controller 100. The memory 503 stores, for example, drive waveform data for causing the liquid output head 52 to output liquid.

The D/A converter 504 is an electric circuit that D/A converts the drive waveform data. The drive IC 510 transmits drive voltage to the piezoelectric elements 520 of the liquid output head 52. The bus line 505 is commonly connected to the above-described components and transmits address signals, data signals, various control signals, and the like. The I/F 501, the ASIC 502, the memory 503, the D/A converter 504, and the drive IC 510 are mutually connected via the bus line 505.

The piezoelectric elements 520 are piezoelectric actuators (laminated piezoelectric elements and thin film piezoelectric elements) that function as energy generation sources that output liquid from the nozzles of the liquid output heads 52. The piezoelectric element 520 contracts and expands in accordance with the drive waveform signal input to the drive IC 510. The piezoelectric element 520 is provided for each nozzle of the liquid output head 52. The liquid output apparatus 10 changes the pressure of liquid chambers in the nozzles by contraction and expansion of the piezoelectric elements 520 and outputs the liquid from the respective nozzles. The head array 50 may include thermal actuators employing electrothermal transducers such as heating resistors, or electrostatic actuators including diaphragms and opposed electrodes, instead of the piezoelectric elements 520.

The maintenance device 70 includes an I/F 701, an ASIC 702, a memory 703, a bus line 704, a drive IC 710, and maintenance mechanisms 71 (71_1 and 71_2).

The I/F 701 is connected to the controller 100 and receives data (information) and signals from the controller 100. The data transmitted from the controller 100 is, for example, data indicating a start request for maintenance of the liquid output head 52. The ASIC 702 performs various signal processing and the like on data (information) and signals received from the controller 100. The ASIC 702 processes control signals for controlling the maintenance process of the maintenance device 70. The memory 703 stores, for example, data received from the controller 100.

The drive IC 710 controls the operation of the maintenance process of the liquid output head 52 by the maintenance mechanism 71. The bus line 704 is commonly connected to the above-described components and transmits address signals, data signals, various control signals, and the like. The I/F 701, the ASIC 702, the memory 703, and the drive IC 710 are mutually connected via the bus line 704.

The maintenance mechanism 71 is a mechanism that performs maintenance on the liquid output heads 52. The maintenance mechanisms 71 are provided in the same number as the number of rows of the liquid output heads 52 provided in the head array 50. For example, as illustrated in FIG. 5, when the head array 50 includes the liquid output heads 52 provided in the two-row staggered arrangement, the maintenance device 70 includes two maintenance mechanisms 71 (71_1 and 71_2).

The maintenance mechanisms 71_1 and 71_2, respectively, include the web units 73_1 and 73_2 and the wiper units 75_1 and 75_2. The web unit 73 is a mechanism with the web 74 that wipes the liquid output surface (nozzle formation surface) of the liquid output head 52, as illustrated in FIG. 3. As illustrated in FIG. 3, the wiper unit 75 is a mechanism with a wiper 76 that wipes the liquid attached to the liquid output surface (nozzle formation surface) of the liquid output head 52 or the dust or the like generated from the recording target P. Although FIG. 7 illustrates an example in which two maintenance mechanisms 71 are provided, the maintenance mechanisms 71 are provided in the same number as the number of arrays (the number of head rows) of the liquid output heads 52 in the head array 50.

The moving mechanism 90 includes an I/F 901, an ASIC 902, a memory 903, a bus line 904, a motor driver 910, and a motor 920.

The I/F 901 is connected to the controller 100 and receives data (information) and signals from the controller 100. The data transmitted from the controller 100 is, for example, data indicating a drive instruction for the liquid output head 52 of the maintenance device 70 in the array direction (X-axis direction). The ASIC 902 performs various signal processing and the like on data (information) and signals received from the controller 100. The memory 903 stores, for example, data received from the controller 100.

The motor driver 910 transmits a drive signal to the motor 920 to drive the motor 920 that moves the maintenance device 70 in the array direction (X-axis direction) of the liquid output heads 52. The bus line 904 is commonly connected to the above-described components and transmits address signals, data signals, various control signals, and the like. The I/F 901, the ASIC 902, the memory 903, and the motor driver 910 are mutually connected via the bus line 904.

Functional Configuration

Figure 8:
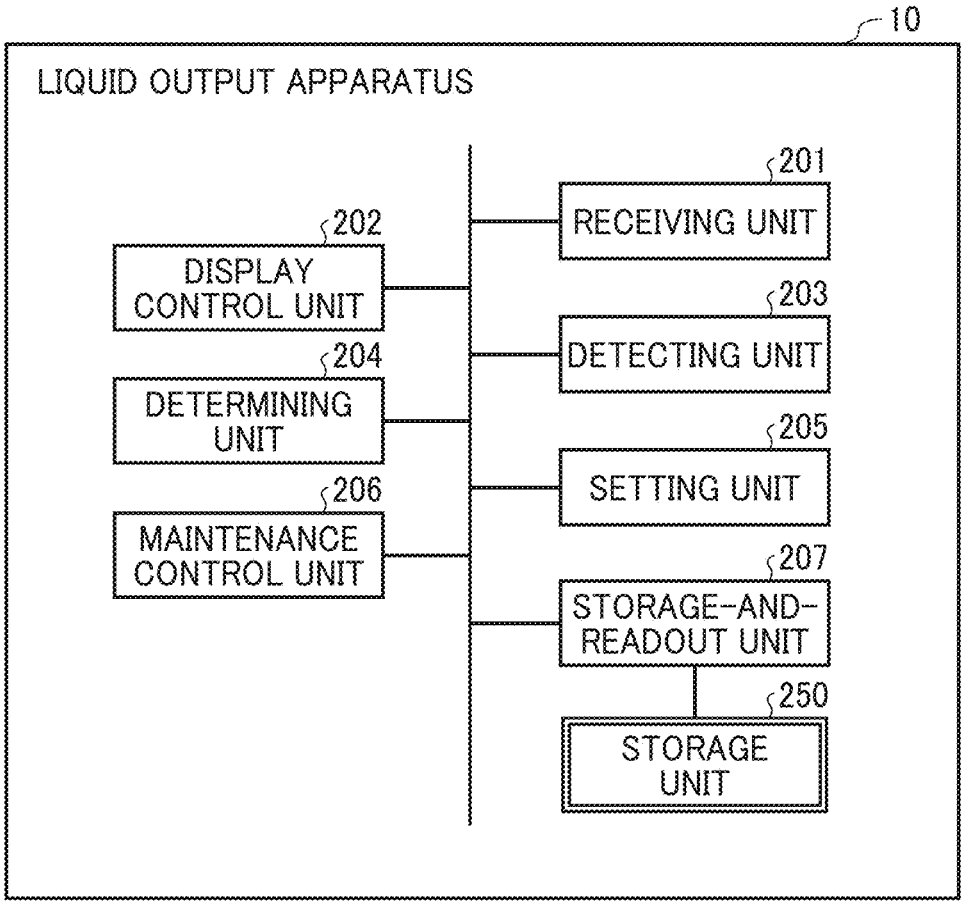
FIG. 8 is a diagram of an example of a functional configuration of the liquid output apparatus according to an embodiment of the present disclosure.

Next, the functional configuration of the liquid output apparatus 10 is described with reference to FIG. 8. FIG. 8 is a diagram of an example of a functional configuration of the liquid output apparatus according to an embodiment of the present disclosure. The functions achieved by the liquid output apparatus 10 include, for example, a receiving unit 201, a display control unit 202, a detecting unit 203, a determining unit 204, a setting unit 205, a maintenance control unit 206, a storage-and-readout unit 207, and a storage unit 250.

The receiving unit 201 receives an input operation by the operator. The receiving unit 201 receives a start request for maintenance on the liquid output head 52 through, for example, an input operation on the operation panel 120 by the operator. The receiving unit 201 is achieved by, for example, the operation panel 120 illustrated in FIG. 6 and a program executed by the ASIC 105 or the CPU 101. The receiving unit 201 is an example of a receiving unit.

The display control unit 202 causes the operation panel 120 illustrated in FIG. 6 to display an operation screen or the like for receiving an input operation by the operator. The display control unit 202 is achieved by, for example, the operation panel 120 illustrated in FIG. 6 and a program executed by the ASIC 105 or the CPU 101.

The detecting unit 203 detects a maintenance start request for the liquid output head 52. For example, based on the input signal received by the receiving unit 201, the detecting unit 203 detects a maintenance start request for the liquid output head 52. The detecting unit 203 is achieved by, for example, a program executed by the ASIC 105 or the CPU 101 illustrated in FIG. 6. The detecting unit 203 may be achieved by the ASIC 702 and the drive IC 710 of the maintenance device 70 illustrated in FIG. 7.

The determining unit 204 determines whether maintenance is needed on each of the liquid output heads 52 in the head array 50. For example, based on the information of the liquid output head 52 included in the maintenance start request detected by the detecting unit 203, the determining unit 204 determines whether the maintenance of the liquid output head 52 is to be performed. The determining unit 204 is achieved by, for example, a program executed by the ASIC 105 or the CPU 101 illustrated in FIG. 6. The determining unit 204 may be achieved by the ASIC 702 and the drive IC 710 of the maintenance device 70 illustrated in FIG. 7. The determining unit 204 is an example of a determining unit.

The setting unit 205 sets the liquid output head 52 on which maintenance is to be performed by the maintenance device 70. The setting unit 205 specifies the maintenance start position of the liquid output head 52 to be processed based on, for example, the position information (coordinate information) of the liquid output head 52 stored in the storage unit 250. The setting unit 205 is achieved by, for example, a program executed by the ASIC 105 or the CPU 101 illustrated in FIG. 6. The setting unit 205 may be achieved by the ASIC 702 and the drive IC 710 of the maintenance device 70 illustrated in FIG. 7.

The maintenance control unit 206 controls the operation of the maintenance on the liquid output head 52 to be processed by the maintenance assembly 80. The maintenance control unit 206 controls, for example, the driving of the maintenance mechanism 71 (the web unit 73 and the wiper unit 75) provided in the maintenance device 70. The maintenance control unit 206 also controls, for example, the movement of the maintenance device 70 moved in the array direction (X-axis direction) of the liquid output heads 52 by the moving mechanism 90. The maintenance control unit 206 is achieved by, for example, a program executed by the ASIC 105 or the CPU 101 illustrated in FIG. 6. The maintenance control unit 206 may be achieved by the ASIC 702 and the drive IC 710 of the maintenance device 70 illustrated in FIG. 7 or the ASIC 902 of the moving mechanism 90 illustrated in FIG. 7.

The storage-and-readout unit 207 stores various data in the storage unit 250 and reads out various data from the storage unit 250. The storage-and-readout unit 207 is achieved by, for example, a program executed by the ASIC 105 or the CPU 101 illustrated in FIG. 6. The storage-and-readout unit 207 may be achieved by the ASIC 702 and the drive IC 710 of the maintenance device 70 illustrated in FIG. 7. The storage unit 250 stores, for example, position information (coordinate information) of the liquid output head 52 and the like. The storage unit 250 is achieved by, for example, the ROM 102 or the NVRAM 104 illustrated in FIG. 6.

Maintenance Method

Figure 9:
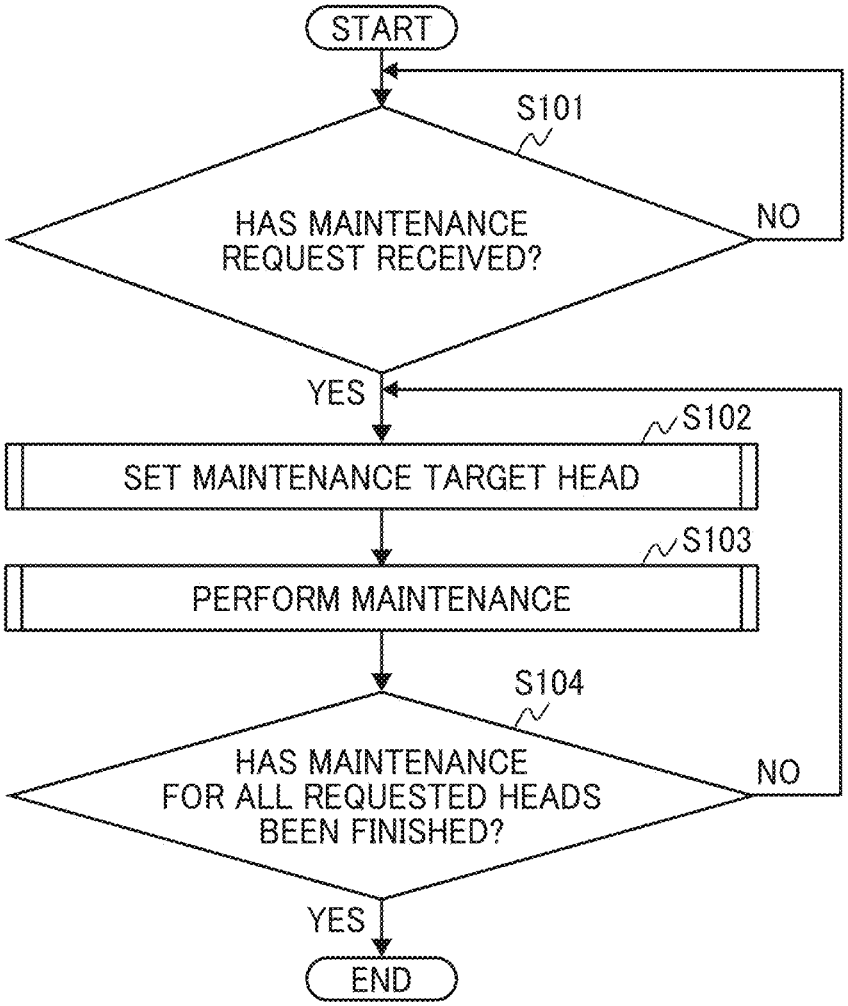
FIG. 9 is a flowchart of an example of a maintenance method in the liquid output apparatus according to an embodiment of the present disclosure.

Next, a maintenance process of the liquid output head 52 in the liquid output apparatus 10 is described with reference to FIGS. 9 to 11. FIG. 9 is a flowchart of an example of the maintenance method in the liquid output apparatus according to an embodiment of the present disclosure. FIG. 9 illustrates a method of maintaining the head array 50 in which five liquid output heads 52 are arranged in each of two rows of staggered rows as illustrated in FIG. 5.

In step S101, when the receiving unit 201 of the maintenance device 70 receives an input of a maintenance request from the operator, the processing proceeds to step S102. For example, the operator performs an input for starting maintenance on the operation screen displayed on the operation panel 120 by the display control unit 202 of the liquid output apparatus 10. The receiving unit 201 of the liquid output apparatus 10 receives the input on the operation screen displayed on the operation panel 120. Based on the input received by the receiving unit 201, the detecting unit 203 detects the maintenance start request. On the other hand, in step S101, when the input of the maintenance request is not received, the receiving unit 201 repeats the processing of step S101.

Figure 10A:
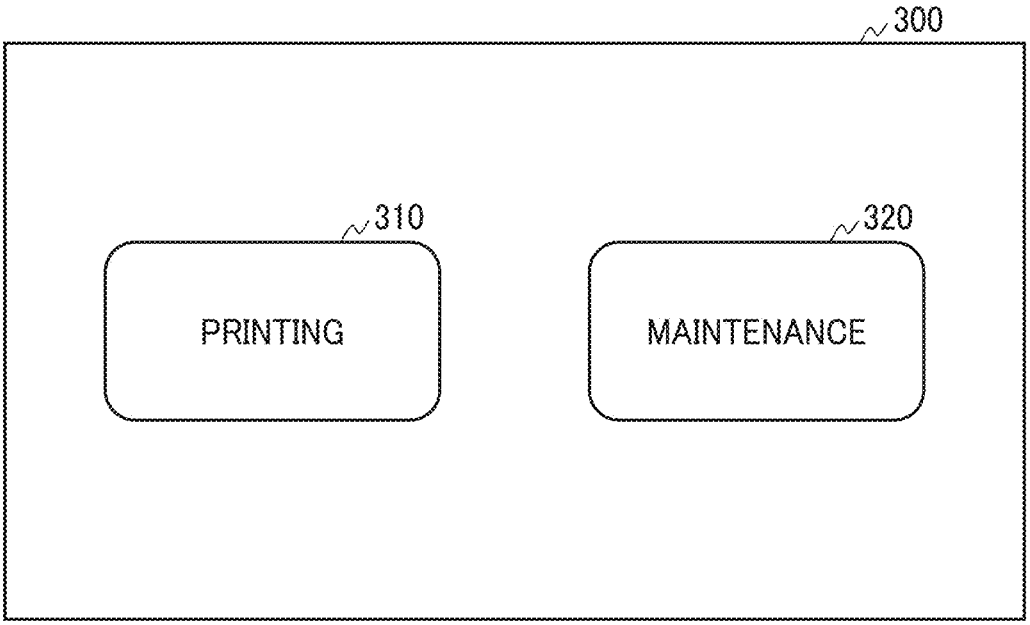
FIG. 10A is a diagram of an example of an operation screen displayed on the liquid output apparatus according to an embodiment of the present disclosure.
Figure 11:
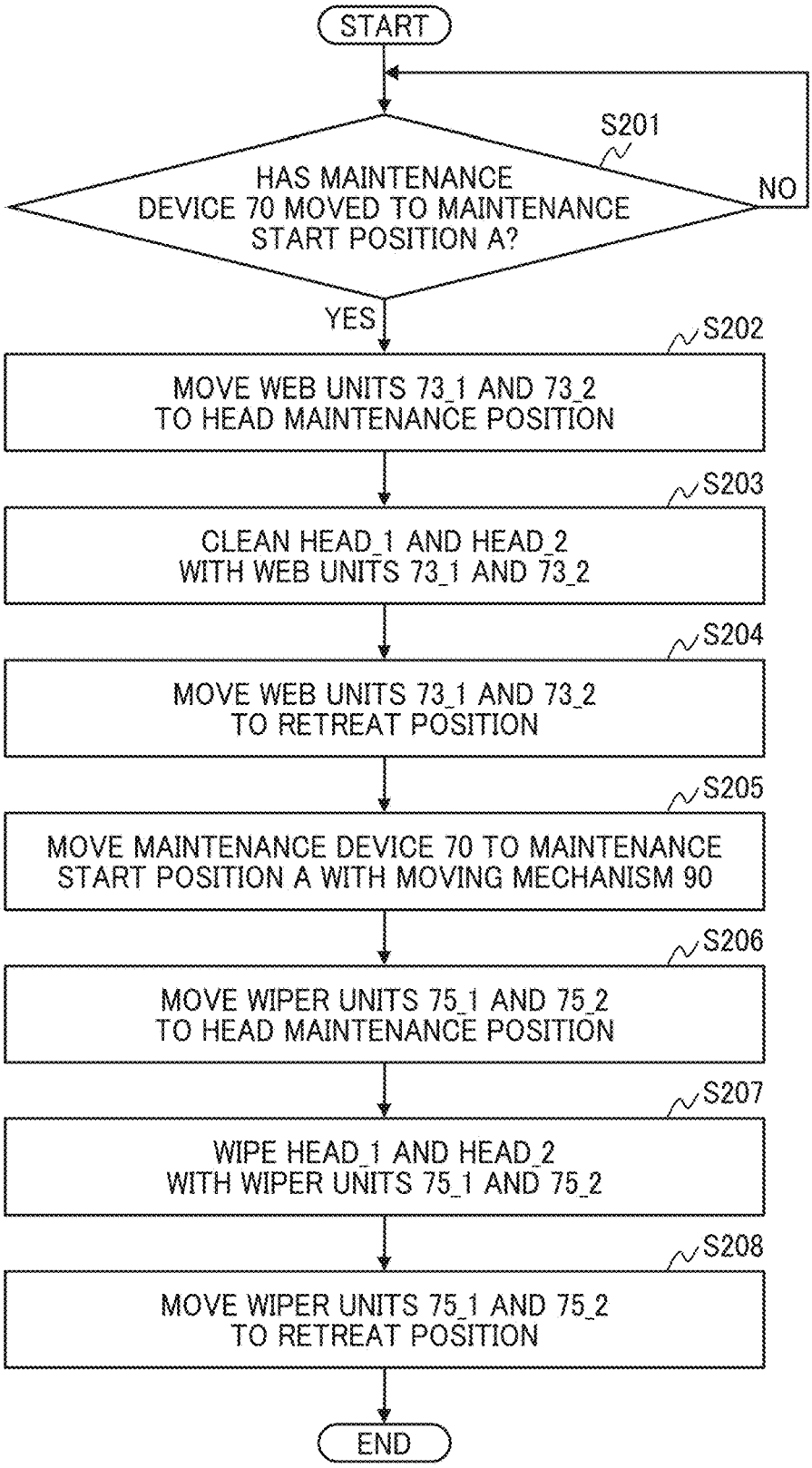
FIG. 11 is a flowchart of an example of a maintenance process in a maintenance control unit according to an embodiment of the present disclosure.

FIG. 10A is a diagram of an example of the operation screen displayed on the liquid output apparatus according to an embodiment of the present disclosure. An operation screen 300 illustrated in FIG. 10A is a screen displayed on the operation panel 120, for example, when the liquid output apparatus 10 is activated. The operation screen 300 includes a selection icon 310 for printing and a selection icon 330 for maintenance. The liquid output apparatus 10 performs printing on a recording target P when an input to the selection icon 310 by the operator is received. On the other hand, when the input to the selection icon 330 by the operator is received, the liquid output apparatus 10 performs maintenance on the liquid output head 52.

Figure 10B:
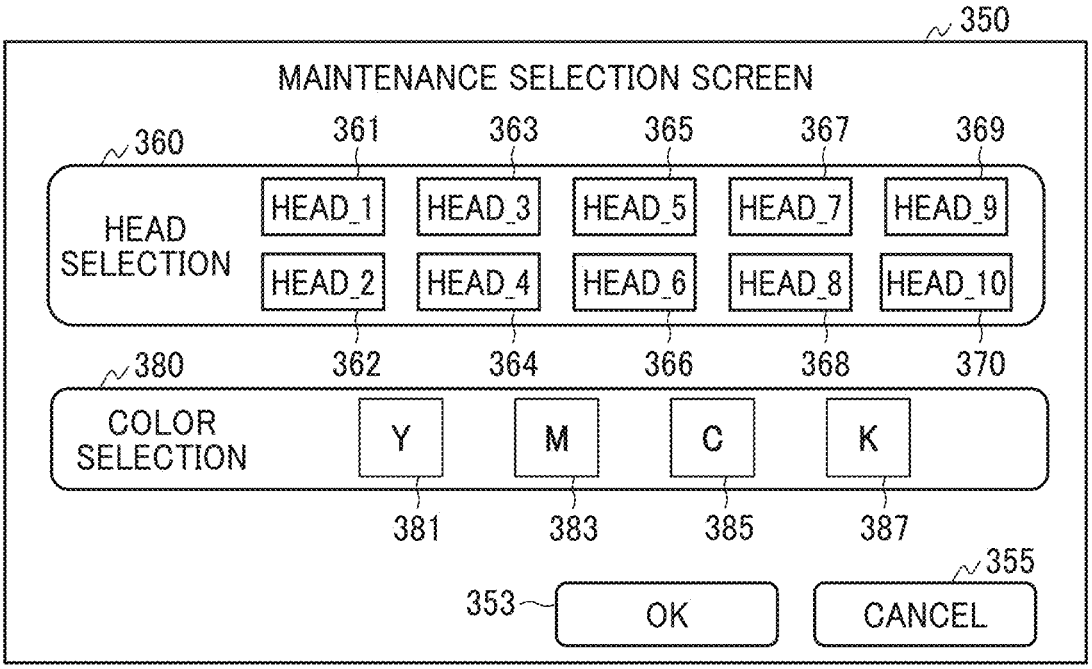
FIG. 10B is a diagram of an example of a maintenance selection screen displayed on the liquid output apparatus according to an embodiment of the present disclosure.

FIG. 10B illustrates an example of a maintenance selection screen 350 for selecting the liquid output head 52 to be subjected to the maintenance. The maintenance selection screen 350 illustrated in FIG. 10B is a screen displayed on the operation panel 120 when an input to the selection icon 330 on the operation screen 300 is received. The maintenance selection screen 350 includes a head selection area 360 for receiving the selection of the liquid output head 52 to be subjected to maintenance and a color selection area 380 for receiving the selection of the liquid output head 52 to be subjected to maintenance by selecting the color of ink output from the liquid output head 52 that performs the maintenance. The maintenance selection screen 350 also includes an "OK" icon 353 to be pressed to start the maintenance and a cancel icon 355 to be pressed to cancel the maintenance.

The head selection area 360 has selection icons 361 to 370 for selecting the liquid output heads 52, respectively, in the liquid output apparatus 10. The operator presses one selection icon corresponding to the liquid output head 52 that performs the maintenance, among the selection icons 361 to 370 included in the head selection area 360, to select the liquid output head 52 that performs the maintenance. One of the selection icons 361 to 370 may be selected. Alternatively, a plurality of selection icons may be simultaneously selected.

The color selection area 380 has selection icons 381, 383, 385, and 387 to select colors of liquid (ink) output from the liquid output heads 52 of the liquid output apparatus 10. When the operator presses, for example, the selection icon 381 for Y, the liquid output apparatus 10 receives a request for maintenance of the liquid output head 52 that outputs yellow ink. When the operator presses, for example, the selection icon 383 for M, the liquid output apparatus 10 receives a request for maintenance of the liquid output head 52 that outputs magenta ink. When the operator presses, for example, the selection icon 385 for C, the liquid output apparatus 10 receives a request for maintenance of the liquid output head 52 that outputs cyan ink. When the operator presses, for example, the selection icon 387 for K, the liquid output apparatus 10 receives a request for maintenance of the liquid output head 52 that outputs ink of a key plate (black).

The liquid output apparatus 10 receives the input for the "OK" icon 353 by the receiving unit 201 in a state in which any of the selection icons included in the head selection area 360 or the color selection area 380 is selected, thus receiving the maintenance start request for the specified liquid output head 52.

The maintenance selection screen 350 may have a configuration in which only the selection icons included in any one of the head selection area 360 and the color selection area 380 may be selectable, or the selection icons included in both the head selection area 360 and the color selection area 380 may be selectable.

In step S102, the setting unit 205 of the maintenance device 70 sets the liquid output head 52 to be subjected to the maintenance. The setting unit 205 sets the liquid output head 52 to be subjected to the maintenance, based on the information included in the maintenance start request detected by the detecting unit 203. The following describes the case in which the setting unit 205 sets all the liquid output heads 52 included in the head array 50 as the liquid output heads 52 to be subjected to the maintenance. The setting unit 205 also sets the maintenance start position for the liquid output heads 52 set as the liquid output heads to be processed. For example, when all the liquid output heads 52 included in the head array 50 are set as the liquid output heads 52 to be processed, the setting unit 205 sets, as the maintenance start position, the position A corresponding to the liquid output heads 52 (head_1 and the head_2) of the head group A closest to the retreat position RP of the maintenance device 70 illustrated in FIG. 5.

In step S103, the maintenance control unit 206 of the maintenance device 70 performs a maintenance process on the liquid output head 52 set by the setting unit 205.

Here, details of the maintenance process are described with reference to FIG. 11. FIG. 11 is a flowchart of an example of the maintenance process in the maintenance control unit according to an embodiment. FIG. 11 illustrates the maintenance process for the liquid output heads 52 (head_1 and the head_2) of the head group A illustrated in FIG. 5.

In step S201, when the maintenance device 70 is moved to the maintenance start position A by the moving mechanism 90, the maintenance control unit 206 proceeds the process to step S202. On the other hand, when the maintenance device 70 is not moved to the maintenance start position A, the maintenance control unit 206 causes the moving mechanism 90 to move the maintenance device 70.

In step S202, the maintenance control unit 206 moves the web unit 73_1 and the web unit 73_2 to the maintenance position of the liquid output head 52. For example, based on a drive signal from the drive IC 710, the maintenance control unit 206 pushes up the web unit 73_1 and the web unit 73_2 from the retreat position inside the maintenance mechanism 71 to the position at which the web unit 73_1 and the web unit 73_2 can wipe the liquid output heads 52.

In step S203, the maintenance control unit 206 cleans the head group A (head_1 and the head_2) by wiping using the web unit 73_1 and the web unit 73_2. For example, the maintenance control unit 206 drives the moving mechanism 90 in the forward direction by the width of the liquid output head 52 to move the web unit 73_1 and the web unit 73_2 to the position A'. Thus, the maintenance control unit 206 can simultaneously perform cleaning on the head_1 and the head_2 belonging to the head group A by the web wiping.

In step S204, the maintenance control unit 206 pushes down the web unit 73_1 and the web unit 73_2 to the retreat position inside the maintenance mechanism 71 based on the drive signal from the drive IC 710.

In step S205, the maintenance control unit 206 causes the moving mechanism 90 to move the maintenance device 70 to the position A, which is the maintenance start position.

In step S206, the maintenance control unit 206 moves the wiper unit 75_1 and the wiper unit 75_2 to the maintenance position of the liquid output heads 52. For example, based on the drive signal from the drive IC 710, the maintenance control unit 206 pushes up the wiper unit 75_1 and the wiper unit 75_2 from the retreat position inside the maintenance device 70 to a position at which the wiper unit 75_1 and the wiper unit 75_2 can wipe the liquid output head 52.

In step S207, the maintenance control unit 206 performs the wiping on the head group A (head_1 and the head_2) using the wiper unit 75_1 and the wiper unit 75_2. For example, the maintenance control unit 206 drives the moving mechanism 90 in the forward direction by the width of the liquid output head 52 to move the wiper unit 75_1 and the wiper unit 75_2 to the position A'. Thus, the maintenance control unit 206 can simultaneously perform wiping on the head_1 and the head_2 belonging to the head group A by wiping, for example, liquid or dust attached to the nozzle formation surfaces of the head_1 and the head_2.

In step S208, the maintenance control unit 206 pushes down the wiper unit 75_1 and the wiper unit 75_2 to the retreat position, based on the drive signal from the drive IC 710.

By the above-described process, the liquid output apparatus 10 can perform maintenance on the head_1 and the head_2 belonging to the head group A in a set, using the maintenance mechanism 71_1 and the maintenance mechanism 71_2 provided in the maintenance device 70.

Returning to FIG. 9, the maintenance process in the liquid output apparatus 10 is further described. In step S104, the liquid output apparatus 10 ends the process when maintenance of all the requested liquid output heads 52 is finished. Alternatively, the liquid output apparatus 10 repeats the process from step S102 when the maintenance of all the requested liquid output heads 52 is not finished. For example, when the maintenance of the head group A (head_1 and the head_2) is finished, the liquid output apparatus 10 performs maintenance on the head group B (head_3 and the head_4). Regarding the maintenance of the head group B, the same process as the process illustrated in steps S102 and S103 and in FIG. 11 are performed. Then, for example, when the maintenance of the head group E (head_9 and the head_10) is finished, the liquid output apparatus 10 ends the process. Thus, the liquid output apparatus 10 can perform maintenance on all the liquid output heads 52 provided in the head array 50.

Effect of Embodiment

As described above, according to an embodiment of the present disclosure, the liquid output apparatus 10 includes the head array 50 having the plurality of liquid output heads 52 arranged in a staggered manner. The liquid output apparatus 10 also includes the maintenance device 70 as an example of maintenance unit to perform maintenance on a plurality of adjacent liquid output heads 52 arranged in different head rows (the head row 55_1 and the head row 55_2) in a set. The maintenance device 70 includes the maintenance mechanisms 71 (71_1 and 71_2) to perform maintenance on the liquid output heads 52 at respective positions corresponding to the positional relationship between the plurality of liquid output heads 52 belonging to the head groups (head groups A to E). The maintenance device 70 perform maintenance on the liquid output heads 52 using the maintenance mechanisms 71 corresponding to the positions of the liquid output heads 52. Thus, in the liquid output apparatus including a plurality of liquid output heads, the liquid output apparatus 10 can shorten the time required for maintenance on the liquid output head.

The liquid output apparatus 10 performs maintenance of all the liquid output heads 52 belonging to the head group in a set by the control operation of the maintenance control unit 206. The liquid output apparatus 10 also performs maintenance on specified liquid output heads 52 in a set. Thus, the liquid output apparatus 10 can shorten the time required to perform maintenance on the plurality of liquid output heads 52 included in the liquid output apparatus 10 and can enhance the control efficiency for the maintenance operation.

First Variation of Embodiment

Next, the liquid output apparatus according to a first variation of the above-described embodiment is described. The same configurations and functions as those of the above-described embodiment are denoted by the same reference codes, and the description thereof are omitted below. The liquid output apparatus 10 according to the first variation of the above-described embodiment performs maintenance on the selected liquid output head 52, which is selected as the liquid output head 52 to be processed by the operator using the operation screen 300 illustrated in FIG. 10A.

Figure 12:
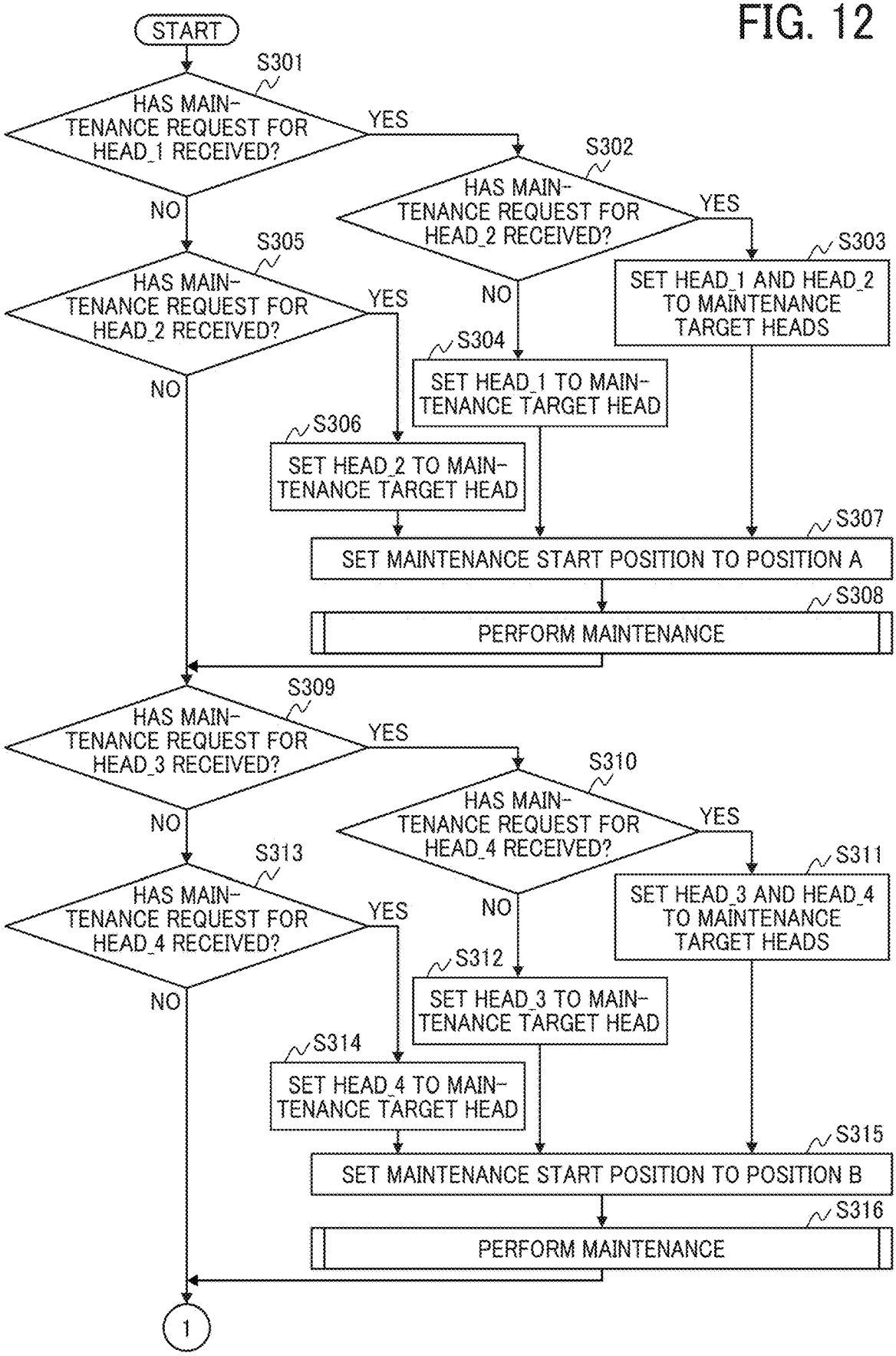
FIG. 12 is a flowchart of a part of an example of a process of setting a liquid output head to be subjected to maintenance in the liquid output apparatus according to a first variation of an embodiment of the present disclosure.
Figure 13:
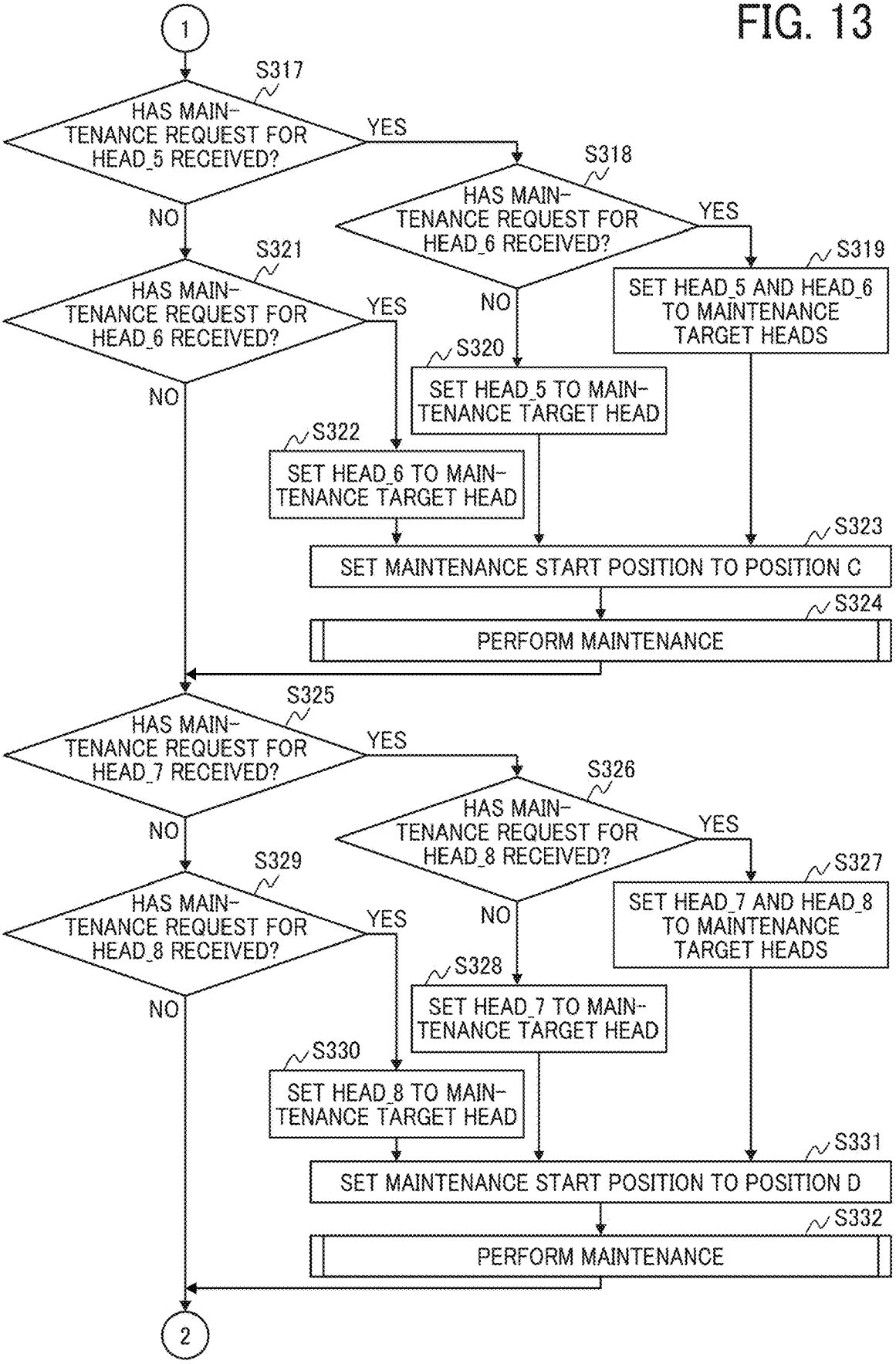
FIG. 13 is a flowchart of another part of the example of the process of setting the liquid output head to be subjected to maintenance in the liquid output apparatus according to the first variation.

FIGS. 12 to 14 illustrate a flowchart of an example of the process of setting a liquid output head to be subjected to maintenance in the liquid output apparatus according to the first variation of the above-described embodiment. FIGS. 12 to 14 illustrate a process to be performed when the maintenance request for a specified liquid output head 52 is received through the maintenance selection screen 350 illustrated in FIG. 10B.

In step S301, when the receiving unit 201 receives a maintenance request for the head_1, the receiving unit 201 proceeds the process to step S302. In step S302, when the receiving unit 201 receives a maintenance request for the head_2, the receiving unit 201 proceeds the process to step S303. In step S303, the setting unit 205 sets the head_1 and the head_2 as the liquid output heads 52 to be subjected to the maintenance. As described above, when the receiving unit 201 receives the maintenance request for all the liquid output heads 52 belonging to the head group by the receiving unit 201, the liquid output apparatus 10 performs maintenance on the liquid output heads 52 belonging to the head group in a set. Alternatively, when the maintenance request for the head_2 is not received in step S302, the receiving unit 201 proceeds the process to step S304. In step S304, the setting unit 205 sets the head_1 to the liquid output head 52 to be subjected to the maintenance.

On the other hand, when the maintenance request for the head_1 is not received in step S301, the receiving unit 201 proceeds the process to step S305. In step S305, when the receiving unit 201 receives the maintenance request for the head 2, receiving unit 201 proceeds the process to step S306. In step S306, the setting unit 205 sets the head_2 to the liquid output head 52 to be subjected to the maintenance. In step S307, the setting unit 205 sets the maintenance start position to the position A. In step S308, the maintenance control unit 206 performs the maintenance process on the liquid output head 52 set as the maintenance target head by the setting unit 205 among the liquid output heads 52 belonging to the head group A. The content of the maintenance process is the same as the content illustrated in FIG. 11.

Next, if the maintenance request for the head_2 is not received by the receiving unit 201 (NO in step S305) or if the maintenance process on the liquid output heads 52 belonging to the head group A by the maintenance control unit 206 is finished (step S308), the process proceeds to step S309.

In step S309, if the receiving unit 201 receives a maintenance request for the head_3, the receiving unit 201 proceeds the process to step S310. In step S310, when the receiving unit 201 receives the maintenance request for the head_4, the receiving unit 201 proceeds the process to step S311. In step S311, the setting unit 205 sets the head_3 and the head_4 to the liquid output heads 52 to be subjected to the maintenance. Alternatively, when the maintenance request for the head_4 is not received in step S310, the receiving unit 201 proceeds the process to step S312. In step S312, the setting unit 205 sets the head_3 to the liquid output head 52 to be subjected to the maintenance.

On the other hand, when the maintenance request for the head_3 is not received in step S309, the receiving unit 201 proceeds the processing to step S313. In step S313, when the receiving unit 201 receives a maintenance request for the head_4, the receiving unit 201 proceeds the process to step S314. In step S314, the setting unit 205 sets the head_4 to the liquid output head 52 to be subjected to the maintenance. In step S315, the setting unit 205 sets the maintenance start position to the position B. In step S316, the maintenance control unit 206 performs maintenance on the liquid output head set as the maintenance target head by the setting unit 205 among the liquid output heads 52 belonging to the head group B. The content of the maintenance process is the same as the content illustrated in FIG. 11.

Next, if the maintenance request for the head_4 is not received by the receiving unit 201 (NO in step S313) or if the maintenance on the liquid output heads 52 belonging to the head group B by the maintenance control unit 206 is finished (step S316), the process proceeds to step S317 illustrated in FIG. 13.

In step S317, if the receiving unit 201 receives a maintenance request for the head_5, the receiving unit 201 proceeds the process to step S318. In step S318, when the receiving unit 201 receives a maintenance request for the head_6, the receiving unit 201 proceeds the process to step S319. In step S319, the setting unit 205 sets the head_5 and the head_6 as the liquid output heads 52 to be subjected to the maintenance. On the other hand, when the maintenance request for the head_6 is not received in step S318, the receiving unit 201 proceeds the process to step S320. In step S320, the setting unit 205 sets the head_5 as the liquid output head 52 to be subjected to the maintenance.

On the other hand, in step S317, when the maintenance request for the head_5 is not received, the receiving unit 201 proceeds the process to step S321. In step S321, if the receiving unit 201 receives a maintenance request for the head_6, the receiving unit 201 proceeds the process to step S322. In step S322, the setting unit 205 sets the head_6 as the liquid output head 52 to be subjected to the maintenance. In step S323, the setting unit 205 sets the maintenance start position to the position C. In step S324, the maintenance control unit 206 performs maintenance on the liquid output head 52 set as the maintenance target head by the setting unit 205 among the liquid output heads 52 belonging to the head group C. The content of the maintenance process is the same as the content illustrated in FIG. 11.

Next, if the maintenance request for the head_6 is not received by the receiving unit 201 (NO in step S321) or if maintenance on the liquid output heads 52 belonging to the head group C by the maintenance control unit 206 is finished (step S324), the process proceeds to step S325.

In step S325, when the receiving unit 201 receives a maintenance request for the head_7, the receiving unit 201 proceeds the process to step S326. In step S326, when the receiving unit 201 receives a maintenance request for the head_8, the receiving unit 201 proceeds the process to step S327. In step S327, the setting unit 205 sets the head_7 and the head_8 as the liquid output heads 52 to be subjected to the maintenance. On the other hand, in step S326, when the maintenance request for the head_8 is not received, the receiving unit 201 proceeds the process to step S328. In step S328, the setting unit 205 sets the head_7 as the liquid output head 52 to be subjected to the maintenance.

On the other hand, when the maintenance request for the head_7 is not received in step S325, the receiving unit 201 proceeds the process to step S329. In step S329, when the receiving unit 201 receives a maintenance request for the head_8, the receiving unit 201 proceeds the process to step S330. In step S330, the setting unit 205 sets the head_8 as the liquid output head 52 to be subjected to the maintenance. In step S331, the setting unit 205 sets the maintenance start position to the position D. In step S332, the maintenance control unit 206 performs maintenance on the liquid output head 52 set as the maintenance target head by the setting unit 205 among the liquid output heads 52 belonging to the head group D. The content of the maintenance process is the same as the content illustrated in FIG. 11.

Next, if the maintenance request for the head_8 is not received by the receiving unit 201 (NO in step S329) or if maintenance on the liquid output heads 52 belonging to the head group D by the maintenance control unit 206 is finished (step S332), the process proceeds to step S333 illustrated in FIG. 13.

In step S333, when the receiving unit 201 receives a maintenance request for the head_9, the receiving unit 201 proceeds the process to step S334. In step S334, when the receiving unit 201 receives a maintenance request for the head_10, the receiving unit 201 proceeds the process to step S335. In step S335, the setting unit 205 sets the head_9 and the head_10 as the liquid output heads 52 to be subjected to maintenance. On the other hand, if the maintenance request for the head_10 is not received in step S334, the receiving unit 201 proceeds the process to step S336. In step S336, the setting unit 205 sets the head_9 as the liquid output head 52 to be subjected to the maintenance.

On the other hand, when the maintenance request for the head_9 is not received in step S333, the receiving unit 201 proceeds the process to step S337. In step S337, when the receiving unit 201 receives a maintenance request for the head_10, the receiving unit 201 proceeds the process to step S338. In step S338, the setting unit 205 sets the head_10 as the liquid output head 52 to be subjected to the maintenance. In step S339, the setting unit 205 sets the maintenance start position to the position E. In step S340, the maintenance control unit 206 performs maintenance on the liquid output head 52 set as the maintenance target head by the setting unit 205 among the liquid output heads 52 belonging to the head group E. The content of the maintenance process is the same as the content illustrated in FIG. 11.

Next, when a maintenance request for the head_10 is not received by the receiving unit 201 (NO in step S337) or when maintenance on the liquid output heads 52 belonging to the head group E by the maintenance control unit 206 is finished (step S340), the maintenance process in the liquid output apparatus 10 is finished.

As described above, the liquid output apparatus 10 according to the first variation of the above-described embodiment receives the selection of the liquid output head 52 that is the target of the maintenance request, through the maintenance selection screen 350 displayed on the operation panel 120, to perform maintenance on the selected liquid output head 52. Thus, the liquid output apparatus 10 according to the first variation can select the liquid output head to be subjected to the maintenance through the input operation by the operator, thus shortening the time for the maintenance of the plurality of liquid output heads 52 included in the liquid output apparatus 10.

When the receiving unit 201 receives a maintenance request for at least one liquid output head 52 of the plurality of liquid output heads 52 belonging to the head group (for example, NO in step S302, YES in step S305, etc.), the liquid output apparatus 10 performs maintenance of all the liquid output heads 52 belonging to the head group. In such a case, the liquid output apparatus 10 can make use of the advantage that maintenance of the liquid output head 52 can be performed in a set, using the maintenance device 70.

Second Variation of Embodiment

Next, the liquid output apparatus according to a second variation of the above-described embodiment is described. According to the second variation, when at least one maintenance request is not received among the plurality of liquid output heads 52 belonging to a head group (for example, the head group A), the liquid output apparatus gives priority to perform maintenance on the liquid output heads 52 belonging to another head group (for example, the head group B) different from the head group. That is, the liquid output apparatus according to the second variation makes use of the advantage that maintenance of a plurality of liquid output heads 52 belonging to a predetermined head group can be performed in a set, to give priority to perform maintenance on the liquid output heads 52 on which maintenance can be performed in a set.

FIG. 15 illustrates a flowchart of an example of the process of setting a liquid output head to be subjected to maintenance in the liquid output apparatus according to the second variation of the above-described embodiment. The process of setting the liquid output head 52 as the maintenance process target illustrated in FIG. 15 is a process executed when the maintenance request is received in step S101 of FIG. 9 (YES in step S101).

In step S102-1, when the receiving unit 201 receives a maintenance request for all the liquid output heads 52 belonging to the head group A, the receiving unit 201 proceeds the process to step S102-2. For example, when the receiving unit 201 receives a maintenance request for the head_1 and the head_2 belonging to the head group A illustrated in FIG. 5, the receiving unit 201 proceeds the process to step S102-2.

In step S102-2, the setting unit 205 sets the head_1 and the head_2 belonging to the head group A to the liquid output heads 52 to be processed. In step S102-3, the setting unit 205 sets the maintenance start position of the liquid output heads 52 to be processed to the position A. The maintenance control unit 206 controls the operation of the maintenance assembly 80 so that maintenance of the head_1 and the head_2 belonging to the head group A is performed in a set. Thus, when the receiving unit 201 receives the maintenance request for all the liquid output heads 52 belonging to the head group by the receiving unit 201, the liquid output apparatus 10 performs maintenance on the liquid output heads 52 belonging to the head group in a set.

On the other hand, if the receiving unit 201 does not receive a maintenance request for at least one of the plurality of liquid output heads 52 belonging to the head group A in step S102-1, the receiving unit 201 proceeds the process to step S102-4. For example, when the maintenance request for at least one of the head_1 and the head_2 belonging to the head group A illustrated in FIG. 5 is not received, the receiving unit 201 proceeds the process to step S102-2.

In step S102-4, the setting unit 205 sets the head_3 and the head_4 belonging to the head group B to the liquid output heads 52 to be processed. For example, since the receiving unit 201 does not receive the maintenance request for at least one of the head_1 and the head_2 belonging to the head group A, the setting unit 205 sets the liquid output heads 52 (the head_3 and the head_4) belonging to the head group B closest to the retreat position (retreat area) RP next to the head group A to the liquid output heads 52 to be processed. In step S102-5, the setting unit 205 sets the maintenance start position of the liquid output heads 52 to be processed to the position B. The maintenance control unit 206 controls the operation of the maintenance assembly 80 so that maintenance of the head_3 and the head_4 belonging to the head group B can be performed in a set. Thus, when the receiving unit 201 does not receive at least one maintenance request for the plurality of liquid output heads 52 belonging to the head group, the liquid output apparatus 10 performs maintenance on the liquid output heads 52 belonging to another head group different from the head group in a set.

The liquid output apparatus 10 performs the same process on the liquid output heads 52 belonging to the head group C and the subsequent groups illustrated in FIG. 5, thus performing maintenance on all the liquid output heads 52 of the head array 50. The maintenance process is the same as the process illustrated in FIG. 11 and descriptions thereof are omitted here.

Accordingly, when the receiving unit 201 does not receive a maintenance request for at least one of the liquid output heads 52 belonging to the head group, the liquid output apparatus according to the second variation controls the operation of the maintenance assembly 80 so as not to perform maintenance on the liquid output heads 52 belonging to the head group. The liquid output apparatus 10 controls the operation of the maintenance assembly 80 to perform maintenance on the liquid output heads 52 belonging to another head group different from the head group. Thus, the liquid output apparatus 10 according to the second variation of the above-described embodiment gives priority to perform maintenance on the liquid output heads 52 belonging to the same head group on which maintenance can be performed in a set using the maintenance device 70, thus allowing the maintenance to be more effectively performed.

The liquid output apparatus 10 may perform maintenance on all of the liquid output heads 52 belonging to head groups on which maintenance can be performed in a set, and then perform maintenance on the liquid output heads 52 belonging to the head group on which maintenance has not been performed in a set.

The liquid output apparatus 10 may also determine the necessity of maintenance for the liquid output head 52 for which the maintenance request has been received by the receiving unit 201. The determining unit 204 determines the necessity of the maintenance for each liquid output head 52 based on the reference information. For example, based on the reference information stored in the storage unit 250, the determining unit 204 determines whether maintenance is to be performed on the liquid output head 52 included in the maintenance start request detected by the detecting unit 203.

Here, the reference information is data (information) serving as a reference for determining whether maintenance is to be performed on the liquid output head 52. The reference information is, for example, data on which liquid output is performed as a test pattern. In such a case, the determining unit 204 compares test pattern data stored in the storage unit 250 with processed data on which liquid output has been actually performed. When a difference greater than or equal to a predetermined threshold is detected, the determining unit 204 determines that the maintenance is to be performed on the liquid output head 52. The reference information may be, for example, the number of times of liquid output performed after the previous maintenance is performed. In such a case, when the number of times of processing accumulated and stored in the storage unit 250 exceeds a predetermined threshold, the determining unit 204 determines that maintenance is to be performed on the corresponding liquid output head 52. The reference information may also be model data of a drive waveform of the liquid output head 52. In such as case, if the determining unit 204 compares the model data stored in the storage unit 250 with the actual drive waveform of the liquid output head 52 and detects a difference greater than or equal to the predetermined threshold, the corresponding liquid output head, the determining unit 204 determines that the maintenance is to be performed on the corresponding liquid output head 52.

As described above, the liquid output apparatus according to an embodiment of the present disclosure includes the plurality of liquid output heads 52 provided in a staggered arrangement and the maintenance assembly 80 that performs maintenance on the liquid output heads 52 in different rows (the head row 55_1 and the head row 55_2) in a set. Thus, the liquid output apparatus 10 performs maintenance on the liquid output heads 52 in different rows (the head row 55_1 and the head row 55_2) by the maintenance assembly 80 in a set, thus shortening the time for performing the maintenance on the plurality of liquid discharge heads 52 of the liquid output apparatus 10.

Further, in the liquid output apparatus according to an embodiment of the present disclosure, the maintenance assembly 80 includes the maintenance mechanisms 71 (71_1 and 71_2) that perform maintenance on the liquid output heads 52. Each of the maintenance mechanisms 71 (71_1 and 71_2) is provided corresponding to one of the rows (the head row 55_1 and the head row 55_2) in which the liquid output heads 52 are arranged. Thus, the liquid output apparatus 10 includes the maintenance mechanisms 71 (71_1 and 71_2), each corresponding to one of the head rows (head row 55_1 and the head row 55_2) in which the liquid output heads 52 are arranged. Such a configuration allows maintenance to be performed on the plurality of liquid output heads 52 in a set, thus shortening the time for performing maintenance on the plurality of liquid output heads 52 of the liquid output apparatus 10.

Further, in the liquid output apparatus according to an embodiment of the present disclosure, the liquid output heads 52 provided in different rows (head row 55_1 and the head row 55_2) are the head_1 (one example of the first liquid output head) and the head_2 (an example of the second liquid output head) that are arranged so as to have a predetermined relative positional relationship. The maintenance mechanisms 71 are the maintenance mechanism 71_1 (an example of the first maintenance mechanism) and the maintenance mechanism 71_2 (an example of the second maintenance mechanism) that have a specific relative positional relationship corresponding to the predetermined relative positional relationship of the head_1 and the head_2. The maintenance assembly 80 performs maintenance on the head_1 using the maintenance mechanism 71_1 and performs maintenance on the head_2 using the maintenance mechanism 71_2, thus performing maintenance in a set on the liquid output heads 52 arranged in different rows (the head row 55_1 and the head row 55_2). Thus, the liquid output apparatus 10 performs maintenance on the liquid output heads 52 arranged in different rows (the head row 55_1 and the head row 55_2) in a set using the maintenance mechanism 71 (71_1 and 71_2) corresponding to each row, thus shortening the time required to perform maintenance on the plurality of liquid output heads 52 of the liquid output apparatus 10.

Furthermore, the liquid output apparatus according to an embodiment of the present disclosure includes the receiving unit 201 (an example of the receiving unit) to receive a maintenance request for the liquid output head 52 and the maintenance control unit 206 (an example of the control unit) to control the maintenance operation of the liquid output head 52 by the maintenance assembly 80 when the maintenance request is received by the receiving unit 201. The head array 50 having the plurality of liquid output heads 52 includes the plurality of head groups including the liquid output heads 52 provided in different rows (the head row 55_1 and the head row 55_2) so as to have a predetermined relative positional relationship (the head groups A to E). The receiving unit 201 receives a maintenance request for each liquid output head 52 (an example of a receiving unit). When the receiving unit 201 receives maintenance requests for all the liquid output heads 52 belonging to a head group, the maintenance control unit 206 controls the maintenance operation by the maintenance assembly 80 so that maintenance of all the liquid output heads 52 belonging to the head group is performed in a set. Accordingly, the liquid output apparatus 10 can perform maintenance of all the liquid output heads 52 belonging to the head group in one set by one control unit. Such a configuration can shorten the time required for the maintenance of the liquid output heads 52 and enhance the control efficiency for maintenance operation.

Further, in the liquid output apparatus according to an embodiment of the present disclosure, when a maintenance request for at least one of the plurality of liquid output heads 52 belonging to a head group (for example, the head group A) by the receiving unit 201 (an example of the receiving unit) is not received by the receiving unit 201, the maintenance control unit 206 (an example of the control unit) controls the maintenance operation by the maintenance assembly 80 so that the maintenance assembly 80 performs maintenance on the plurality of liquid output heads 52 belonging to another head group (for example, the head group B) different from the head group in a set. Accordingly, the liquid output apparatus 10 can give priority to perform maintenance on the liquid output heads 52 on which maintenance can be performed in a set, thus allowing maintenance to be more efficiently performed on the plurality of liquid output heads 52 included in the liquid output apparatus 10.

Furthermore, in the liquid output apparatus according to an embodiment of the present disclosure, the maintenance assembly 80 includes the maintenance device 70 including the plurality of maintenance mechanisms 71 (71_1 and 71_2) to perform maintenance on the liquid output head 52 and the moving mechanism 90 (an example of a moving device) to move the maintenance device 70 along each of the rows (the head row 55_1 and the head row 55_2) in which the liquid output heads 52 are arranged. The maintenance assembly 80 causes the moving mechanism 90 to move the maintenance device 70 to the position (for example, the maintenance start position A) of the liquid output head 52 subjected to maintenance, thus performing the maintenance on the liquid output heads 52 provided in different rows in a set. Accordingly, the liquid output apparatus 10 moves the maintenance device 70 along the rows in which the liquid output heads 52 are arranged, thus allowing maintenance on the liquid output heads 52 to be performed in a set using the maintenance mechanism 71 (71_1 and 71_2) included in the maintenance device 70. Such a configuration can further shorten the time required for maintenance on the plurality of liquid output heads 52 of the liquid output apparatus 10 and enhance the control efficiency for the maintenance operation.

The maintenance control method according to an embodiment of the present disclosure is a maintenance control method executed by the liquid output apparatus 10 that includes the plurality of liquid output heads 52 and the maintenance assembly 80. The plurality of liquid output heads 52 is provided in a staggered arrangement. The maintenance assembly 80 includes the maintenance mechanisms 71 (71_1 and 71_2) that perform maintenance on the liquid output heads 52. Each of the maintenance mechanisms 71 (71_1 and 71_2) is provided corresponding to one of rows (the head row 55_1 and the head row 55_2) in which the liquid output heads 52 are arranged. The method executes a control step of controlling the maintenance operation of the maintenance assembly 80 so that maintenance on two or more liquid output heads 52 provided in different rows (the head row 55_1 and the head row 55_2) is performed in a set using the maintenance mechanisms 71. Thus, the liquid output apparatus 10 performs maintenance on the liquid output heads 52 in different rows (the head row 55_1 and the head row 55_2) by the maintenance assembly 80 in a set, thus shortening the time for performing the maintenance on the plurality of liquid output heads 52 of the liquid output apparatus 10.

In each embodiment of the present disclosure, the liquid output apparatus 10 is not limited to an image forming apparatus that outputs liquid from the liquid output heads 52 to form an image on a recording target P such as a sheet, and may be, for example, a three-dimensional fabricating apparatus (three-dimensional shaping apparatus) that discharges a fabrication liquid to a powder layer formed of powder in a layer form to fabricate a three-dimensional fabrication object (three-dimensional object). The liquid output apparatus 10 may be a treatment liquid application apparatus that applies treatment liquid to apply the treatment liquid to a surface of a recording medium to reform the surface of the recording medium. The liquid output apparatus 10 may be, for example, an injection granulator that injects composition liquid dispersed in a solution of raw material through a liquid output head to granulate fine particles of the raw material. Furthermore, the liquid output apparatus 10 is not limited to an apparatus capable of applying liquid to a recording target P but may be an apparatus that applies liquid to the air or liquid.

The liquid output apparatus 10 may also include a device related to feeding, conveyance, or ejection of the recording target P, as well as a pre-treatment device, a post-processing device, and the like. Furthermore, the liquid output apparatus 10 is not limited to a non-scanning type device that does not move the head array 50 (the liquid output heads 52). The liquid output apparatus 10 may be, for example, a scanning type device that moves the head array 50 (the liquid output heads 52), a device that moves the head array 50 (the liquid output heads 52) relative to the recording target P.

In each embodiment of the present disclosure, the recording target P is not limited to the sheet but may be any object to which liquid can be temporarily attached. The recording target P is an object to which liquid is attached and firmly adheres or an object to which liquid is attached and penetrates. The recording target P may be, for example, a medium such as recording paper, a recording sheet of paper, film, or cloth, an electronic component such as an electronic substrate or a piezoelectric element, or a medium such as a powder layer (powder particle layer), an organ model, or a test cell. The recording target P is any medium to which liquid can be attached. The material of the recording target P may be any material, such as paper, thread, fiber, fabric, leather, metal, plastic, glass, wood, or ceramic, on which liquid can be at least temporarily attached.

In each embodiment of the present disclosure, the liquid output from the liquid output head 52 may be any liquid having a viscosity or surface tension that can be output from the liquid output head 52. Although the liquid is not limited to any particular liquid, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. The above-described examples can be used, for example, for inkjet inks, surface treatment liquids, liquids for forming constituent elements of electronic elements and light-emitting elements or resist patterns of electronic circuits, and material liquids for three-dimensional fabrication.

In each embodiment of the present disclosure, the liquid output head 52 includes one that discharges liquid, one that ejects liquid, one that applies liquid, and the like.

Also, the functions of each embodiment of the present disclosure can be achieved by computer-executable programs described in a legacy programming language such as assembler, C, C++, C #, Java (registered trademark) or an object-oriented programming language. Programs for executing the functions of each embodiment can be distributed through telecommunication lines.

Furthermore, programs for executing the functions of each embodiment of the present disclosure may be stored in and distributed in the form of a ROM, an electrically erasable programmable read-only memory (EEPROM), an erasable programmable read-only memory (EPROM), a flash memory, a flexible disk, a compact disc (CD)-ROM, a CD-RW (re-writable), a DVD-ROM, a DVD-RAM, a DVD-RW, a Blu-ray disc, an secured digital (SD) card, and a device readable recording medium such as Magneto-Optical (MO) disc.

A part or all of the functions of each embodiment of the present disclosure can be implemented on a programmable device (PD) such as, for example, a field programmable gate array (FPGA), or can be implemented as an ASIC. Alternatively, a part or all of the functions of each embodiment of the present disclosure can be distributed by a recording medium as circuit configuration data (bit stream data) to be downloaded to the PD to achieve the functions of each embodiment on the PD or data described in the hardware description language (HDL) for generating the circuit configuration data, very high speed integrated circuits hardware description language (VHDL), Verilog-HDL, etc.

Although the liquid output apparatus, the maintenance control method, and a recording medium storing the program according to some embodiments of the present disclosure have been described above, embodiments of the present disclosure are not limited to the above-described embodiments. The above-described embodiments of the present disclosure may be modified within a range that can be conceived by those skilled in the art. The modification includes additions of other embodiments, modifications, and deletions. The modification is included in the scope of the present disclosure as long as the functions and effects of the present disclosure are obtained.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid output apparatus, comprising:

a plurality of liquid output heads arranged in a staggered arrangement;

a maintenance assembly configured to selectively perform maintenance on the plurality of liquid output heads in different rows in a set based on a request of a maintenance for each of the plurality of liquid output heads, and move longitudinally along the plurality of liquid output heads to a position of one of the plurality of liquid output heads which is to have maintenance performed;

processing circuitry configured to receive the request for the maintenance on each of the plurality of liquid output heads and to control an operation of the maintenance performed by the maintenance assembly; and a head array including a plurality of head groups, each of the plurality of head groups including liquid output heads in the different rows in a positional relationship, wherein the processing circuitry is configured to receive the request of the maintenance for each of the plurality of liquid output heads, wherein the processing circuitry is configured to cause the maintenance assembly not to perform the maintenance on all the liquid output heads belonging to one head group of the plurality of head groups when the processing circuitry does not receive the request of the maintenance for at least one of the liquid output heads belonging to the one head group.

2. The liquid output apparatus according to claim 1, wherein the maintenance assembly includes a plurality of maintenance mechanisms corresponding to the different rows, respectively, in which the plurality of liquid output heads are arranged, and wherein the maintenance assembly is configured to perform the maintenance on the plurality of liquid output heads with the plurality of maintenance mechanisms.

3. The liquid output apparatus according to claim 2, wherein the plurality of liquid output heads in the different rows include a first liquid output head and a second liquid output head arranged in a positional relationship, wherein the plurality of maintenance mechanisms includes a first maintenance mechanism and a second maintenance mechanism arranged in a positional relationship corresponding to the positional relationship of the first and second liquid output heads, and wherein the maintenance assembly is configured to perform the maintenance on the first liquid output head with the first maintenance mechanism and on the second liquid output head with the second maintenance mechanism, to perform the maintenance on the plurality of liquid output heads in the different rows in a set.

4. The liquid output apparatus according to claim 1, further comprising a head array including a plurality of head groups, each of the plurality of head groups including liquid output heads in the different rows in a positional relationship, wherein the processing circuitry is configured to receive the request of the maintenance for each of the plurality of liquid output heads, wherein the processing circuitry is configured to cause the maintenance assembly to perform the maintenance on all the liquid output heads belonging to one head group of the plurality of head groups in a set when the processing circuitry receives requests of the maintenance for all the liquid output heads belonging to the one head group.

5. The liquid output apparatus according to claim 1, wherein the processing circuitry is configured to control the maintenance assembly to perform the maintenance on liquid output heads belonging to another head group different from the one head group in a set based on the processing circuitry not receiving the request of the maintenance for at least one of the liquid output heads belonging to the one head group.

6. The liquid output apparatus according to claim 1, wherein the maintenance assembly further includes:

a maintenance device including a plurality of maintenance mechanisms corresponding to the different rows, respectively, in which the plurality of liquid output heads are arranged, the plurality of maintenance mechanisms configured to perform the maintenance on the plurality of liquid output heads; and a moving mechanism configured to move the maintenance device along the different rows in which the plurality of liquid output heads is arranged, and wherein the maintenance assembly is configured to move the maintenance device with the moving mechanism to a position of liquid output heads to be subjected to the maintenance, to perform the maintenance on the plurality of liquid output heads in the different rows in a set.

7. The liquid output apparatus of claim 1, wherein the maintenance assembly includes a web configured to wipe a liquid output surface of one of the plurality of liquid output heads, and a wiper unit configured to wipe the liquid output surface of the one of the plurality of liquid output heads.

8. The liquid output apparatus according to claim 7, wherein the web is further configured to wipe a cleaning liquid on the liquid output surface of one of the plurality of liquid output heads, and wherein the wiper unit is separate from the web, and is configured to wipe the cleaning liquid applied by the web.

9. The liquid output apparatus according to claim 1, further comprising a conveyance drum to convey a sheet and face the plurality of liquid output heads.

10. The liquid output apparatus according to claim 9, wherein a plurality of groups of the plurality of liquid output heads and the maintenance assembly is arranged in a circumferential direction of the conveyance drum.

11. The liquid output apparatus according to claim 1, further comprising a moisturizing cap configured to be moved to match one of the plurality of liquid output heads and engage the one of the plurality of liquid output heads to maintain a liquid output surface of the liquid output head in a moisturized state.

12. A maintenance control method to be executed by a liquid output apparatus that includes a plurality of liquid output heads arranged in a staggered arrangement, a maintenance assembly including a plurality of maintenance mechanisms corresponding to different rows, respectively, in which the plurality of liquid output heads is arranged, and a head array including a plurality of head groups, each of the plurality of head groups including liquid output heads in the different rows in a positional relationship, the method comprising:

causing the maintenance assembly to selectively perform maintenance on the plurality of liquid output heads based on a request of a maintenance for each of the plurality of liquid output heads, which are in the different rows, in a set with the plurality of maintenance mechanisms corresponding to the different rows, causing the maintenance assembly to move longitudinally along the plurality of liquid output heads to a position of one of the plurality of liquid output heads which is to have maintenance performed, and causing the maintenance assembly not to perform the maintenance on all the liquid output heads belonging to one head group of the plurality of head groups based on not receiving the request of the maintenance for at least one of the liquid output heads belonging to the one head group.

13. A liquid output apparatus, comprising:

a plurality of liquid output heads arranged in a staggered arrangement of at least two rows, each row including liquid output heads arranged in a longitudinal direction of each row;

a maintenance assembly configured to perform maintenance on the plurality of liquid output heads sequentially for each set of liquid output heads respectively disposed in the at least two rows, moving from one end to another end in a longitudinal direction of the staggered arrangement in which the plurality of liquid output heads are arranged;

processing circuitry configured to receive a request for the maintenance on each of the plurality of liquid output heads and to control an operation of the maintenance performed by the maintenance assembly; and a head array including a plurality of head groups, each of the plurality of head groups including liquid output heads in the at least two rows in a positional relationship, wherein the processing circuitry is configured to receive the request of the maintenance for each of the plurality of liquid output heads, wherein the processing circuitry is configured to cause the maintenance assembly not to perform the maintenance on all the liquid output heads belonging to one head group of the plurality of head groups when the processing circuitry does not receive the request of the maintenance for at least one of the liquid output heads belonging to the one head group.

14. The liquid output apparatus according to claim 13, wherein the maintenance assembly is configured to move in a same direction as the longitudinal direction of the staggered arrangement in which the plurality of liquid output heads is arranged.

15. The liquid output apparatus according to claim 13, further comprising a conveyance drum to convey a sheet and face the plurality of liquid output heads.

16. The liquid output apparatus according to claim 15, wherein a plurality of groups of the plurality of liquid output heads and the maintenance assembly is arranged in a circumferential direction of the conveyance drum.

17. The liquid output apparatus according to claim 13, wherein the plurality of liquid output heads is arranged in a staggered arrangement.

* * * * *